US006250977B1

(12) United States Patent
Ness

(10) Patent No.: US 6,250,977 B1
(45) Date of Patent: Jun. 26, 2001

(54) COMPRESSED-AIR-POWERED IMMERSIBLE PRIME MOVER PROVIDING IMPULSE PROPULSION TO POOL CLEANERS, TROLLING BOATS, AND SCUBA DIVERS

(76) Inventor: Dwight Ness, 19231 Beckford Pl., Northridge, CA (US) 91324

( * ) Notice: Subject to any disclaimer, the term of this patent is extended or adjusted under 35 U.S.C. 154(b) by 0 days.

(21) Appl. No.: 09/277,714

(22) Filed: Mar. 26, 1999

(51) Int. Cl.[7] ..... B63H 11/00

(52) U.S. Cl. ..... 440/38; 114/315; 134/167 R; 15/1.7

(58) Field of Search ..... 440/38–39, 44, 440/45, 47; 114/315; 134/167 R; 15/1.7

(56) References Cited

U.S. PATENT DOCUMENTS

| | | | | |
|---|---|---|---|---|
| 1,167,139 | * | 1/1916 | Williams | 440/45 |
| 4,169,484 | * | 10/1979 | Bonight et al. | 134/167 R |
| 4,211,300 | * | 7/1980 | Miller | 367/144 |
| 4,285,415 | * | 8/1981 | Paitson | 367/144 |
| 5,267,883 | * | 12/1993 | Gudmundsen | 440/38 |
| 5,293,659 | * | 3/1994 | Rief et al. | 15/1.7 |
| 5,655,246 | * | 8/1997 | Chang | 15/1.7 |

* cited by examiner

*Primary Examiner*—Jesus D. Sotelo

(57) ABSTRACT

An immersed prime mover device, typically of some few cubic inches or feet in volume, cyclically vents accumulated compressed air, typically 10–200 P.S.I. and more typically 90–110 P.S.I. derived from air compressors or from storage tanks, forcibly eject a slug of water, thereby producing a propulsive force. The accumulation may be some few cubic inches per minute in a large reservoir to but cyclically occasionally or infrequently eject the slug of water, producing an intermittent propulsive force. The accumulation may be of some substantial portion of the volume of an accumulation reservoir every few seconds, frequently cyclically ejecting the slug of water to produce a nearly continuous propulsive force. The device works by accumulating compressed air in two portions of a single chamber, one portion of which is periodically vented though a pressure relief valve to move a sliding assembly within the chamber which, when moved, lets all the compressed air stored within the other portion of the chamber egress the chamber through a pipe in which water is present, thus strongly directionally forcibly ejecting this water as a slug. The strong force periodically so produced is useful to propel a pool cleaner, various small boats especially for trolling during fishing, scuba apparatus, surfboards, aquatic maneuvering units and aquatic devices of diverse types. On land the periodically-ejected fluid may be used for a fountain, or a water cannon.

39 Claims, 6 Drawing Sheets

TO CONTROLLER
TO AIR PRESSURE IN
4
3
32
33
12
1
13
127
128
126
122
132
131
123
129
133
124
1335
1333
1331
1332
1334

2
21
125
121
121a
121b
14

FIG. 4
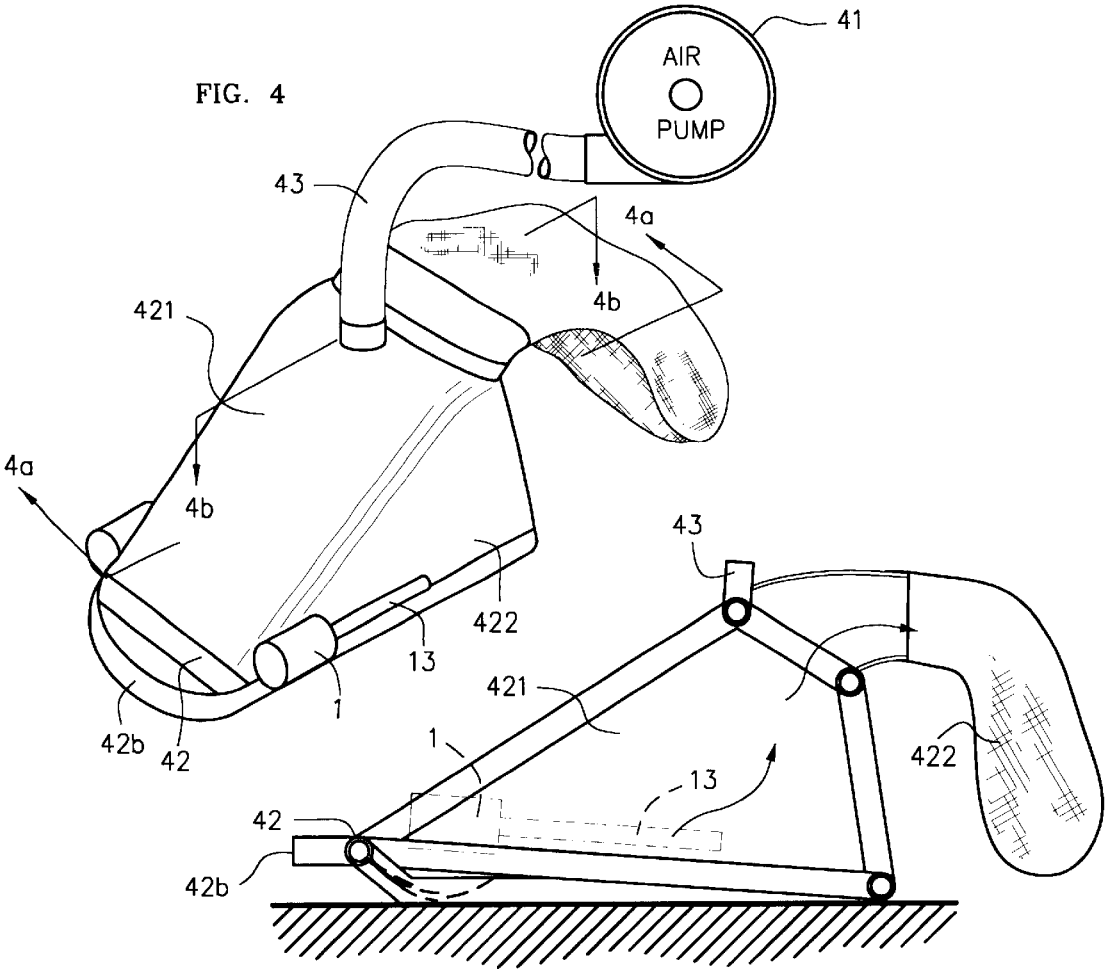
FIG. 4a
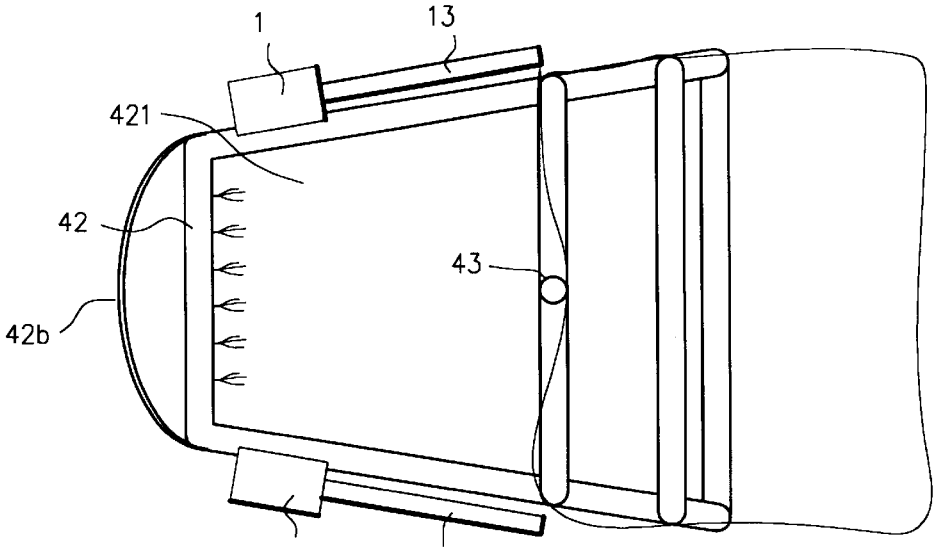
FIG. 4b

COMPRESSED-AIR-POWERED IMMERSIBLE PRIME MOVER PROVIDING IMPULSE PROPULSION TO POOL CLEANERS, TROLLING BOATS, AND SCUBA DIVERS

BACKGROUND OF THE INVENTION

1. Field of the Invention

The present invention generally concerns (i) immersible, underwater and on-water, prime movers that forcibly expel water in jets, (ii) diverse underwater and on-water items including pool cleaners, boats, surf-and-rescue boards, aquatic maneuvering units and scuba apparatus propelled by such prime movers, and also (iii) land-based fountains and water cannons using the water so expelled. The present invention particularly concerns an immersible prime mover powered by compressed air to, upon a triggering event, forcibly expel a slug of water, producing thereby an impulse force that may suitably be used for, among other things, propulsion.

2. Description of the Prior Art

U.S. Pat. No. 4,211,300 to Miller for an AIR GUN WITH RECIPROCATING SHUTTLE having some of the elements of the air-actuated prime mover device of the present invention. Miller shows an improved air gun consists of an elongated cylindrical housing for containing a volume of compressed air that is closed at each end by end plates. A radially-positioned exhaust port is bored into the wall of the housing. A hollow, cylindrical shuttle, is mounted concentrically inside the housing for linear back-and-forth sliding motion in alternate strokes. The ends of the shuttle are closed by end faces. The present invention will also be seen to have a typically cylindrical housing, a reciprocating sliding member that is in part hollow and, in some variants, one or more radially-positioned ports. However, the detail structure, and in gross operation, of the present invention will be seen to be different from the air gun of Miller, who does not put his exhaust air to any particular use.

In Miller's air gun a radially positioned sealing pad has an orifice that may be aligned with the exhaust port which is supported by the shuttle. When the shuttle is at either end of a stroke, the sealing pad blocks the exhaust port. The space between each shuttle end face and the respective housing end plates form shuttle-actuation control chambers. A small air leak in each control chamber maintains the residual air pressure therein at ambient when the guns is inactive. To fire the gun, a small quantity of air is diverted by a valve from inside the housing to one of the control chambers. The inrush of compressed air to the control chamber greatly exceeds the leakage rate of the air leak and accelerates the shuttle towards the opposite end of the housing. During passage from one end of the housing to the other, the orifice in the sealing pad momentarily opens the exhaust port to emit a jet of compressed air. Upon completion of the stroke, the diversion valve is disabled and the residual air pressure in the control chamber returns to ambient.

Also relevant to the prime mover aspect of Applicant's invention is U.S. Pat. No. 4,285,415 to Paitson for an ACOUSTIC IMPULSE GENERATOR. The Paitson invention is directed to producing a powerful acoustic signal, or shock wave. Paitson describes an apparatus for controlling a release of pressurized fluid in order to generate such an acoustic or shock wave impulse for use in underwater reflection seismic surveys. Compressed air is supplied to the acoustic impulse generator and is used both to provide the compressed air acoustic impulse and to retain two piston members in sealing engagement with each other to maintain the compressed air within the apparatus. The two internal pistons are hollow, open-ended cylindrical members, and are adapted to slide axially within a cylindrical chamber and exhaust one another to preclude escape of compressed air. To fire the acoustic impulse generator, compressed air pressure holding the first piston member in position over a series of exhaust ports is suddenly reduced, causing that piston to shift within its chamber, exposing the ports to atmosphere and thereby emitting an acoustic impulse of compressed air. Immediately thereafter, residual air pressure within the device causes the second piston to shift in the same direction following the first piston to again close the exhaust ports and preclude further escape of compressed gas, thus defining an acoustic impulse of finite duration.

Also relevant is United States Patent no. 5,765,374 to Hansen for a GAS DRIVEN MECHANICAL OSCILLATOR AND METHOD showing a sophisticated delivery of compressed gases to a piston oscillating bi-directionally, as will be the case in the present invention. The apparatus and method of Hansen concerns a gas driven oscillator comprising an engine having a cylinder and a pair of expansion chambers on either side of a floating piston adapted to reciprocate within the cylinder. The piston is mounted on a piston rod extending through the cylinder and into a compressor. Compressed air is delivered from a tank to the engine via a pair of valves mounted on an adjustment screw and slidably disposed on the piston rod. The spacing between the valves can be adjusted in order to vary the amplitude of the piston within the cylinder. The piston rod includes spaced slots which alternate align with passages inside the respective valves to deliver a pulse of compressed air to the respective chambers of the cylinder. Mercury is added to or discharged from a tank which is rigidly secured to a piston rod to vary the inertia of the oscillation.

The present invention will also be seen to concern applications of a new prime mover device, notably including as the propulsive unit of a pool cleaner.

In this regard, United States Patent no. 4,169,484 to Bonigut, et. al. for an AUTOMATIC POOL CLEANER APPARATUS concerns an automatic pool cleaner apparatus including an elongated flexible conduit adapted to be connected at one end to a source of water under pressure and adapted to be connected at its other end to the rear of a body portion, said body portion having a plurality of water jet openings further defined on the rear thereof and positioned in a symmetrical relationship about the center line axis of said body portion, such that water discharged therefrom is directed to the rear substantially axially along the direction of said conduit, and further including means for maintaining said body portion in a submerged state, and means for causing said body to be oriented during its movements a substantial portion of the time in positions adjacent to the wall and bottom surfaces of said pool.

Similarly, U.S. Pat. No. 5,293,659 to Rief, et. al. for an AUTOMATIC SWIMMING POOL CLEANER concerns a suction head for a swimming pool cleaner comprising a housing which is open at its lower side and has inclined bristles attached to its lower edge for supporting on a surface to be cleaned. The housing has a rotary sleeve mounted to its top for connection of a suction hose in turn to be connected to a water suction pump. Said sleeve opens in a chamber within the housing in which a vibratory element is pivotally mounted, said element having a crescent or air-foil shape. By a flow of water sucked through said chamber, the vibratory element is automatically brought into a vibrating movement which imparts pulsations on the suction head.

Thereby, the inclined bristles are bent and straightened repetitively resulting in a forward thrust moving the suction head over the surface to be cleaned. At least one foot is disposed in the housing which is cyclically displaced vertically by a driving mechanism driven by the movement of the vibratory element and returned by return springs. Said foot cyclically lifts off the suction head at one side, resulting in a rotational movement of the suction head about a vertical axis so as to change the direction of forward movement of the suction head.

Finally, U.S. Pat. No. 5,655,246 to Chang for a PULSATING SUBMERSIBLE POOL CLEANER concerns a pulsating submergible pool cleaner which has a hollow body connected to a pool pump through a flexible hose. An integrated reed valve and relief valve receive the full flow of water from the pump, with the reed valve closing, forcing the relief valve open generating hydraulic cyclic pulsations. An inlet mounting foot is attached to the hollow body and a flexible circular debris removing disc is removably connected to the foot. The foot and disc engage the submerged surface by the suction of the pool pump, and the cleaner is propelled around the pool surfaces by the cyclic pulsation generated by the integrated valves. Debris is removed and ingested into the cleaner by the scrubbing action of the disc, combined with high velocity water flow entering the body under the disc through small passageways. A leaf catching net may be added as an accessory for collecting large debris, such as leaves of plants. The pool cleaner patents in general show that, although air is useful for dislodging and floating debris during pool cleaning, compressed air is an uncommon source of energy for a pool cleaner.

SUMMARY OF THE INVENTION

The present invention contemplates a prime mover device that is most commonly used completely immersed in water in order to produce force impulses (i) of any desired magnitude, including very large force impulses on the order of tens and hundreds of pounds force for, typically, some few seconds resulting from prime mover devices of cubic foot size, (ii) at any desired interval, ranging from frequent repetition rates of every few seconds or tens of seconds to very infrequent repetition rates on the-order of once every few minutes, tens of minutes and hours.

The prime mover device is powered by compressed gas, normally compressed air at some tens or few hundreds of pounds pressure, which is accumulated over time. Rather than directly expelling the accumulated compressed air under water, which would be inefficient due to the low mass of the air, the device uses the accumulated compressed air to expel a slug of water, thereby efficiently converting the energy of compression into a high-impulse thrusting, or motive, impulse force that may be used, among other applications, for both underwater and in-water propulsion.

The thrusting force impulses may be controlled by diverse manual or mechanical or electrical means so as to occur periodically, or sporadically, or even individually at desired times, including at widely separated times. The pulsating type of propulsive force produced by the prime mover device has special applications. The pulsating thrusting force impulses produced are easily controlled to be quite close together so that an essentially continuous motive force is provided. However, in many interesting applications of the prime mover device, it is controlled (equally easily) to deliver its thrusting force impulses only periodically These thrusting force impulses may be used, for example, to periodically impart an strong impulse motion to a head of pool cleaner. The force impulses from the prime mover move the pool cleaner head in position along the surfaces of a pool simultaneously that the debris scavenged by the cleaner head is both (i) forcibly dislodged, and (ii) scavenged into a reservoir. These thrusting force impulses be used for imparting propulsion to a water craft. For example, a boat or a canoe may be propelled, especially for trolling where the periodic expulsions of water may attract fish. For example, a surf board or a rescue board or diverse types of aquatic objects may be propelled.

These thrusting force impulses may be used for providing a single large forward thrust, or boost, to certain aquatic equipments. For example, a strong impulse may be provided to a scuba apparatus during scuba diving to free a driver from entangling plants, or to escape undertow or turbulence. For example, the prime mover may be used to propel and undersea power maneuvering unit.

The water expelled from the prime mover may alternatively be used on land. The prime mover may be, in particular, used in conjunction with a water supply to shoot a slug of water in a fountain, or from a water cannon.

1. A Compressed-Air-Powered Underwater Prime Mover

In accordance with the present invention an immersible prime mover device is useable with, and powered by, an external source of compressed gas. The device includes a housing defining a chamber accumulating compressed gas from the external source of compressed gas. The chamber has (i) ports through which compressed gas from the external source is received into the chamber, and (ii) an orifice. Gas will be expelled from the chamber through the orifice but not directly. The gas will instead at times be ported into a tubular member (so-called because it is not exactly a "tube") that proceeds through the orifice of the chamber. It may thus be said that the gas is occasionally ported into, and expelled through, the tubular member which itself proceeds through the orifice of the chamber. Exactly what the structure is that permits this occasional porting and gas expulsion, and how it works, is one subject of the present invention.

In the prime mover of the present invention a piston slides within the chamber so as to divide the chamber into two variable portions. An open-ended tubular member is affixed to the sliding piston for sliding therewith. This tubular member passes through the housing's chamber's orifice and, in its sliding motion, so passes through to a variable extension. This tubular member has at least one circumferential hole between its interior and its exterior, and formally a plurality of large holes circumferentially arrayed. These holes are positioned- at a location longitudinally along the member so that they will fall within, or without, the chamber depending upon the position of the sliding piston.

A pressure relief valve, which opens a predetermined threshold pressure, can vent gas from a first portion of the chamber.

During operation, compressed gas from the external source of compressed gas is received through the ports into both portions of the chamber, and accumulates there. Nothing else happens, and nothing moves, until the threshold pressure eventually comes to be exceeded in the first portion of the chamber. The pressure relief valve then rapidly vents the accumulated compressed gas from this first portion of the chamber, causing a momentary differential gas pressure force across the piston between the second portion of the chamber, which is still substantially pressurized, and the first portion of the chamber, which is being vented.

The sliding piston moves rapidly longitudinally within the chamber under force of the differential gas pressure across it. The tubular member affixed to the sliding piston is therein also moved, and slides through the chamber's orifice. This movement of the tubular member pulls its holes from a position exterior to the chamber to a position interior to the second portion of the chamber/ As soon as these holes enter the second portion of the chamber the accumulated compressed gas stored within this second portion of the chamber egresses through the holes and through the tubular member, which is immersed in water.

In accordance with the present invention, the tubular member has a considerable enclosed volume, normally realized by simple linear extension, in it's portion outside the chamber. This interior volume of the tubular member is preferably approximately as large as the volume of the second portion of the chamber, and is more preferably of even larger volume than is the chamber's second portion. By this construction, and this relationship of volumes, all or substantially all of the compressed gas vented from the second portion of the chamber through the sliding tubular member will not be expelled into the water-directly, but will instead serve to strongly directionally ejected water accumulated in eh volume of the tube as a "slug". This "slug" of water has much greater much than does the compressed air that moves it. It is essentially incompressible. It is force into, and against, the surrounding water. Ejection of this slug of water efficiently imparts a strong motive force.

The prime mover device preferably (but not necessarily) further includes a spring that is located between (i) the housing and (ii) the sliding-piston-and-tubular-member. The spring stores up force during sliding movement of the sliding piston and, when the differential gas pressure force across the sliding piston is spent, serves to move the sliding piston its affixed tubular member, making that the holes of the tubular member again return to the exterior of the chamber. Notably, once these holes are exterior to the chamber, the tubular member will fill with water through them—even if the tubular member is otherwise positionally disposed at an angular orientation relative to vertical at which gas might tend to be captured.

By this structure and this operation, periodic ventings of accumulated compressed gas by the pressure relief valve make the sliding piston and tubular member slide, under differential gas pressure and spring forces, cyclicly bi-directionally longitudinally within the chamber, oscillating between accumulation and venting phases and causing the periodic ejection of a slug of water.

2. Variant Embodiments of a Compressed-Air-Powered Underwater Prime Mover Device in Accordance with the Present Invention Therefore, in accordance with the present invention and in greater detail, an immersible prime mover device is useable with, and powered from, an external source of compressed gas, commonly compressed air. The compressed air may be derived, by way of example, from an air compressor located in air on land or a floating platform, and conveyed to the immersed prime mover by a hose. The compressed air may alternatively be derived from an air storage tank. An air storage tank may be located either in air or submerged at a position detached from but hose-connected to the prime mover. It may alternatively be located right at the prime mover—in which case the tank normally moves along with the prime mover that it serves to power.

The prime mover device has a hollow housing with an internal chamber in the substantial shape of a prism, normally a cylinder. The cylindrical chamber has a longitudinal axis and two ends. The second end of the cylindrical chamber has and defines an orifice.

A spring is preferably affixed to the interior of the chamber at its first end, which first end is opposite to the chambers's second-end orifice. The spring serves to forcibly bias anything with which it is in contact within the interior of the chamber to separation from the chamber's first end.

A sliding element of complex form, but in the substantial shape of (i) a plate, or piston, with (ii) axial elongate members oppositely extending perpendicularly from each side of the plate, is located interior to the housing's chamber. When the chamber is cylindrical then the plate is in the shape of an annular disk. The disk is positioned transverse to the axis of the cylinder so as to occupy a cross-sectional area of the chamber, dividing the chamber substantially airtight into two portions.

A first-side axial elongate member extends from the sliding element longitudinally within a first portion of the chamber to contact the first-end spring means.

A second-side axial elongate member extends from the sliding element longitudinally oppositely in the second portion of the chamber, and through the chamber's second-end orifice, to a exhaust end termination at a point normally well beyond the chamber's second-end interior (apertured) wall. This second-side elongate member is hollow, presenting an axial longitudinal cavity, in at least a region proceeding from (i) its immersed open, exhaust, end at least so far as (ii) a point where, in certain operational conditions, the second-side elongate member can be made to extend through the chamber's second-end orifice and into the chamber' second portion. This second-side elongate member has at, and in, its circumference at a location longitudinally displaced from its exhaust end, at least one hole, and normally an array of abundant large holes, that flow connect its exterior to its hollow interior cavity. The longitudinally-displaced location of these holes is, like the cavity itself, at least so far from the exhaust end as a point where, in certain operational conditions, the second-side elongate member can be made to extend through the chamber's second-end orifice and into the chamber's second portion.

Some small thought at this point about the above-stated definitions of the second-side axial elongate member, and its cavity, and its at least one hole, will reveal that, at some "certain operational conditions" yet to be defined, the second-side axial elongate member (and all of the sliding element of which it forms a part) can be withdrawn so far within the chamber that its holes will become exposed within the chamber's second portion. This exposure will permit, for example, gas to egress (i) through the holes and (ii) along the axial longitudinal cavity and (iii) out the exhaust end opening. This exhaust end opening, and more commonly the entire prime mover device, is immersed in fluid, normally water. This gas egress will prove important later; for now it is sufficient merely to understand that the geometry of the second-side axial elongate member, and the sliding element of which it forms a part, fully support this gas egress.

Conversely, under "certain operational conditions" yet to be defined the second-side axial elongate member (and all of the sliding element of which it forms a part) will be extended so far without the chamber that its holes will become exposed to the fluid (water) (typically) surrounding the chamber. This exposure will permit the fluid, normally water, to then ingress through the holes and fill the hollow interior of the tubular member. This filling will prove important later; for now it is sufficient merely to understand that the geometry of the second-side axial elongate member, and the sliding element of which it forms a part, fully support this fluid (water) ingress.

Continuing with the structure of the prime mover device, various alternative structures support that compressed air will enter both chambers of the housing.

In one simple, first, embodiment the housing has and defines two ports at longitudinally spaced-apart positions.

In another, second, embodiment, the elongate tubular member has and defines, at a location opposite to its tubular end, an internal channel. This channel is between that end which is opposite to the exhaust end, and (at least) two holes in the side of the member, one upon each side of the plate. The channel is thus bifurcated from an end hole to two side holes: a bifurcated internal channel. A single aperture through the housing flow connects to a tube that in turn extends into this internal bifurcated channel of the elongate tubular member. Because this bifurcated channel extends both (i) within a part of the tubular member that is (always) within the first portion of the chamber to a first hole within this first portion of the chamber, and (in regions where the tubular member is not hollow) also (ii) within a part of the tubular member that is (always) within the second portion of the chamber to a second hole within this second portion of the chamber, the bifurcated channel will flow-communicate gas received from the external source of compressed gas into both portions of the chamber. The bifurcated channel thus comprises another, second, way of communicating compressed gas to both portions of the chamber.

In yet another, third, embodiment an aperture through the housing again flow connects directly to the first portion of the chamber. A one-way valve in the plate of the sliding member flow communicates compressed gas from the first portion of the chamber to the second portion of the chamber. The one-way, or check, valve within the plate is thus yet another, third, way of communicating compressed gas to both portions of the chamber.

Regardless of the embodiment of the ports by which both portions of the housing's interior chamber become filled with compressed gas, there must be, and is, a mechanism for rapidly venting the compressed gas accumulated in the chamber's first portion. Commonly a relief valve is located between (i) the exterior of the housing and (ii) the first portion of its interior chamber. (This location may mean that relief valve is ported either (i) directly into the chamber's first portion, or (ii) indirectly into the chamber's first portion through that one of the two ports which serves to flow connect to this. It makes no difference.) The relief valve serves to quickly and substantially vent gas from the first portion of the chamber upon a threshold pressure being exceeded. After venting, and when a lower pressure has been achieved in the chamber's first portion, the relief valve means will reset shut.

In operation the prime mover device functions as follows.

In an initial operational state the spring force biases the sliding element in position so that its plate, or disk, is positioned between the spaced-apart ports, serving to make that compressed gas flow-communicated through the two ports should flow into each of the housing's internal chamber's two portions. At this time the at least one circumferential hole (and most normally the several large holes) of the hollow-interior second elongate member is (are) located outboard of the chamber's second portion interior wall. The hollow interior of the second elongate member fills, through its open exhaust end and/or its hole(s), with the fluid, normally water, in which it is immersed. At this time the relief valve is closed. No air gets out of the chamber anywhere; there being insubstantial leakage occurring, in particular, through the chamber's second-end orifice which is plugged substantially airtight by the second elongate member extending therethrough (Normally a circumferential seal, or O-ring, is used at this junction.) Air simply accumulates in both the first and second portions of the chamber at—in accordance with the laws of gas physics—equal pressure in both. No mechanical movement transpires within the prime mover device.

Air may thus be accumulated in the chamber under pressure for, depending upon the supply pressure and the ports' sizes and the chamber volume, a considerable period of time. Ultimately, the air pressure within the chamber rising to exceed the threshold pressure of the relief valve, the relief valve will trigger. Compressed air will then be vented from the first portion the chamber into the surrounding fluid, or wherever. Some air may attempt to flow, or may actually flow, out the second portion of the chamber and into the chamber's first portion which is then being vented. This flow may transpire, in the first embodiment of the ports, out the gas port that is flow-communicative with this second portion and into the gas port that is flow-communicative with the chambers's first portion. This flow may transpire, in the second embodiment of the ports, through the bifurcated channel. In the third embodiment of the flow ports, there may be a slight time to close and/or leakage back through the one-way valve between the chambers' second and first portions.

Furthermore, if the source of compressed air is not turned off, which it need not be and normally is not, then some compressed air from (ii) the source of compressed air will still enter the chamber's first portion even while this first portion is being vented.

Finally, some compressed air may bypass the edges of the plate (of the sliding element) which divides the chamber into two portions, and may pass from (iii) the chamber's second portion into its first portion. (There may be a seal, or O-ring, between the plate and the interior wall of the chamber; however, this is not absolutely necessary.)

Importantly, all these effects are normally small, insignificant and completely harmless. The gas (air) ports, hoses channels and/or one-way valves by which both chamber portions are filled are normally small in relation to the opening through which the relief valve vents the chamber's first portion: but little air can come into the chamber's venting first portion through this route. The source of compressed air supplies air at a rate that is much, much less than the rate at which it is vented: but little air can come into the chamber's venting first portion through this route. The leakage past the plate from the second portion of the chamber to its venting first portion is insignificant: but little air can come into the chamber's venting first portion through this route. Normally, and as a "rule of thumb", the rate of flow of air from each of these sources is less than one-tenth (1/10), and is normally less than one-hundredth (1/100), the rate of gas flow out the opened relief valve.

Instead, the opening of the relief valve causes a strong immediate pressure differential across the plate, forcibly moving the sliding element (of which the plate forms a part) towards the first end of the chamber. The spring is compressed against the first-end elongate member, and against the sliding element (of which the first-end elongate member forms a part). When the sliding element is stopped against the spring, its plate is normally still positioned between the spaced-apart ports.

A great change in gas flow occurs, however, resultantly to this minor movement. The sliding movement of the sliding element causes its second-end hollow elongate member to be pulled inward through the chamber's orifice sufficiently far so that its one or more holes are drawn within the (second portion of the) chamber.

This hole (these holes), and the hollow interior of the second-end elongate member to which they connect, are collectively of large area—typically even larger than the opening through which gas is vented from the chamber's first portion via the relief valve. The compressed gas within the chamber's second portion is substantially entirely immediately expelled through the second-end elongate member's one or more holes, along the axial cavity of the second elongate member, out the second-end elongate members exhaust end opening and into a fluid within which this exhaust end opening is immersed.

Importantly, prior to this expulsion, a column of fluid had accumulated in the open-ended cavity of the second elongate member. The rapid expulsion of compressed air (from the camber's second portion though the exposed one or more holes into the cavity forces this accumulated fluid column as a slug from out the exhaust end opening of the second elongate member. Thus fluid is forcibly expelled into fluid, providing a thrusting force impulse. The thrusting force acts along the entire axial length of the sliding element, through the stop against the first chamber's spring, and into the housing, producing a force upon the entire device which, by dint of this action, is properly called a "prime mover".

At such later time as most compressed air has been expelled from the second chamber as well as the first chamber, thus substantially equalizing pressure forces between the chambers, then under force of the spring the sliding element will return to its quiescent against a stop, therein permitting that continuing ingress of compressed gas from the external source through the gas ports will ultimately accrue within the chambers to re-enact the entire cycle all over again.

The only moving part of the prime mover device is its sliding element (its internal spring also being compressed and released) or, if the relief valve also is considered to be part of the device —and it need not invariably be so considered—the sliding element and the relief valve. The relief valve is itself typically a spring-loaded device. Each of these elements is energy efficient: not much energy is lost in the compression, and release, of a spring. The energy lost in venting compressed gas from the first chamber is basically stored in the internal spring.

Accordingly, substantially all of the energy within the compressed gas supplied to the prime mnover device goes to producing the thrust impulse. It should be understood that merely forcibly ejecting a jet of gas into water—such as is not done in the present invention -can be inefficient (i) because the gas is of low mass, much less than the water, and/or (ii) insofar as the water is laterally displaced, the ejected gas will forming a giant "bubble" instead of a cylindrical "jet". In accordance with the preferred embodiment of the invention, the hollow cavity of the second elongate member is extended well outside the chamber, and presents a volume equal to or larger than the second portion of the chamber. This volume fills with water between cycles of expulsion. When the compressed gas is vented from the chamber's second portion then this slug of water from the hollow second elongate member is directed straight into the surrounding water, producing a highly-directional water-against-water force that is highly efficient to produce thrust.

3. Uses of A Compressed-Air-Powered Underwater Prime Mover

The immersible prime mover device in accordance with the present invention forcibly expels water in impulses.

The impulses may be of predetermined force as is determined mostly by the volume of the prime mover and its operating pressure, i.e., the threshold pressure at which the pressure relief valve triggers. The pressure relief valve, which has an occluding element that moves off a seat against the force of a simple spring, may be provided with a screw so as to adjust upwards and downwards (within the safety range of the housing's chamber) the threshold pressure (differential) at which triggering, and also reset, will occur. Notably, these simple adjustments can be made in the environment(s) of, and at the time(s) of, use.

The impulses may be of controlled frequency as is determined mostly by the volume of the prime mover and the rate of the flow of pressurized air. It is also possible to change the size of the ports to the housing's chamber. Notably, adjustment in the rate (volume per unit time) of air flow, and/or in any restriction(s) to this air flow, can also be made in the environment(s),and at the time(s), of use.

Accordingly, a prime mover in accordance with the present invention is adjustable in the magnitude, and in the frequency, of the thrusting force impulses that it produces.

3.1 A Swimming Pool Cleaner

One use for the prime mover device of the present invention is as the motive means of the scavenging head of a bathing basin, or swimming pool cleaner. The preferred swimming pool cleaner head is connected by an air hose to an air compressor typically located alongside the pool. The air compressor is typically electrically powered.

The preferred swimming pool cleaner head is in the substantial shape of a wedge with a separate prime mover device at each front side corner. The two prime mover devices may optionally be plumb connected to share a common relief valve, and thus cycle at the same time, tending to impart a straight motion to the pool cleaner head to which they are affixed. Alternatively, the prime mover devices may operate independently, tending to impart a side-to-side serpentine or twisting motion to the pool cleaner head. The plumbing of air may be integrated with a tubular frame of the pool cleaner, the compressed air being carried within a hollow tubular frame.

In the preferred embodiment, a neutral buoyancy, water-filled, scavenging chamber shaped something like the catcher of a reel-type lawn mower serves to define the wedge shape. The entire pool cleaner head assembly may be molded from plastic, or may be realized by stretching fabric over a plastic or metal frame. The scavenging chamber rises to an internal ledge, which falls off into sump.

When the water expulsion from either, or from both, of the co-controlled pair of prime mover devices (i.e., the two separate prime mover devices plumb-connected to share a common relief valve, and thus cycling at the same times), is vented against the pool bottom or sides, then pool debris is stirred up from the bottom, agitated in turbulent water, and momentarily mixed with air. This is a very good combination for lifting, at least momentarily, even stubborn debris and other contamination off the surfaces of the pool where it has collected. The loosened debris, which typically momentarily gains buoyancy from the air bubbles, is floated upwards and, with the forward-thrusting movement of the entire cleaner head, rearward in the scavenging bag, collecting at the rear top. Ultimately, over the course of minutes and of hours, the debris loses buoyancy, and sinks downward into the sump of the scavenging bag. The scavenging chamber is periodically lifted out of the pool and emptied.

3.2 A Propulsion Unit for a Boat or Canoe

Another use for the prime mover device of the present invention is as the propulsion unit of a boat or canoe, especially as operated for trolling during fishing.

A submerged prime mover device is typically rotationally mounted so as to be directionally pointed relative to the axis of the boat by manipulation of a tiller or the like. Compressed air is provided to the prime mover through an air hose either from (i) an air compressor (that is typically electrically powered by a battery), or (ii) the compressed air of an air tank, typically a scuba tank.

The prime mover device provides a periodic forward impetus that moves the boat, typically but slowly. The motive impulses are commonly small and/or frequent which, with the great mass of the boat relative to the ejected water, produces a typically gentle and continuous motion. It is, however, possible to cycle the prime mover powerfully and/or infrequently, imparting motive fore in spurts and in spasms, which can be useful in fishing. Namely, the occasional forward thrust imparted to the boat causes such movement in fish bait trailed behind the boat as causes it to more realistically emulate the pulsing movement of actual marine food sources, and to attract fish bites. (The principle is well known to fisherman.)

Second, it is believed that the sound produced by the prime mover device attracts the attention of fish. It is even contemplated that "fish calls" attached to the prime mover device's outlet opening could adapt the pressure wave, or underwater sound, produced to more closely emulate actual maritime occurrences, further heightening the appeal to fish.

3.3 A Propulsion Unit for Aquatic Apparatus

The prime mover device of the present invention may be affixed to surfboards, rescue boards, lifeguard rescue buoys, surface and subsurface aquatic maneuvering units and diverse sorts of aquatic devices to which pressurized air can be communicated, or which can carry air tanks. In many uses the prime mover is manually controlled, single impulses of propulsive power being generated as and when needed to overcome wave and current forces, escape collision(s) with objects in or upon the water including weapons, and/or other situations that call for momentary, as opposed to lengthily sustained, propulsive force.

3.4 A Propulsion Unit for a Scuba Diver

A simple and compact, but potentially high pressure version of the prime mover device of the present invention—which device is thus produces a powerful thrusting force—may be used attached to the tank or harness of a scuba diver, and supplied under diver control with air from his/her scuba tank. A strong force may be selectively generated to free a driver from entangling plants, or to escape undertow or turbulence. The propulsion force may be used by Navy seals or like underwater military personnel to escape hazard. Conversely, the prime mover may used simply for fun, especially in making recreational use of remaining air in a nearly spent scuba tank that must be refilled anyhow.

In this application the mechanism of the prime -mover is simple, lightweight, reliable and safe.

3.5 Land Uses

The prime mover device of the present invention may be used to good effect on land. At least the hollow second-end elongate member is normally permitted to fill with water. Water expelled from this elongate member, and from the prime mover, may serve as a slug of water in a pulsating fountain, or in a water cannon.

At large and/or powerful scale of the prime mover, the expelled pulses of water or other liquids such as de-icer or detergent may be used for purposes such as the breaking of ice, or the washing of vehicles.

In a smaller and simpler embodiment, it is possible to position a prime mover to clean clogged drains and toilet bowls. The prime mover is positioned in water over the clogged drain or toilet bowl, and forcibly held. It is charged with air through a hose from a foot-operated air pump, or a bicycle pump, or an air tank or the like. When the prime mover discharges while held in place, a powerful shock wave is generated directionally in the fluid, potentially dislodging a clog.

These and other aspects and attributes of the present invention will become increasingly clear upon reference to the following drawings and accompanying specification.

BRIEF DESCRIPTION OF THE DRAWINGS

Referring particularly to the drawings for the purpose of illustration only and not to limit the scope of the invention in any way, these illustrations follow:

FIG. 4 is a diagrammatic perspective view showing two prime mover devices in accordance with the present invention in use to propel a pool cleaner.

FIG. 4*a* is a cut-away side plan view of the swimming pool cleaner head previously seen in FIG. 4.

FIG. 4*b* is a top plan view of the swimming pool cleaner head previously seen in FIG. 4.

DESCRIPTION OF THE PREFERRED EMBODIMENT

Although specific embodiments of the invention will now be described with reference to the drawings, it should be understood that such embodiments are by way of example only and are merely illustrative of but a small number of the many possible specific embodiments to which the principles of the invention may be applied. Various changes and modifications obvious to one skilled in the art to which the invention pertains are deemed to be within the spirit, scope and contemplation of the invention as further defined in the appended claims.

Figure 1A:
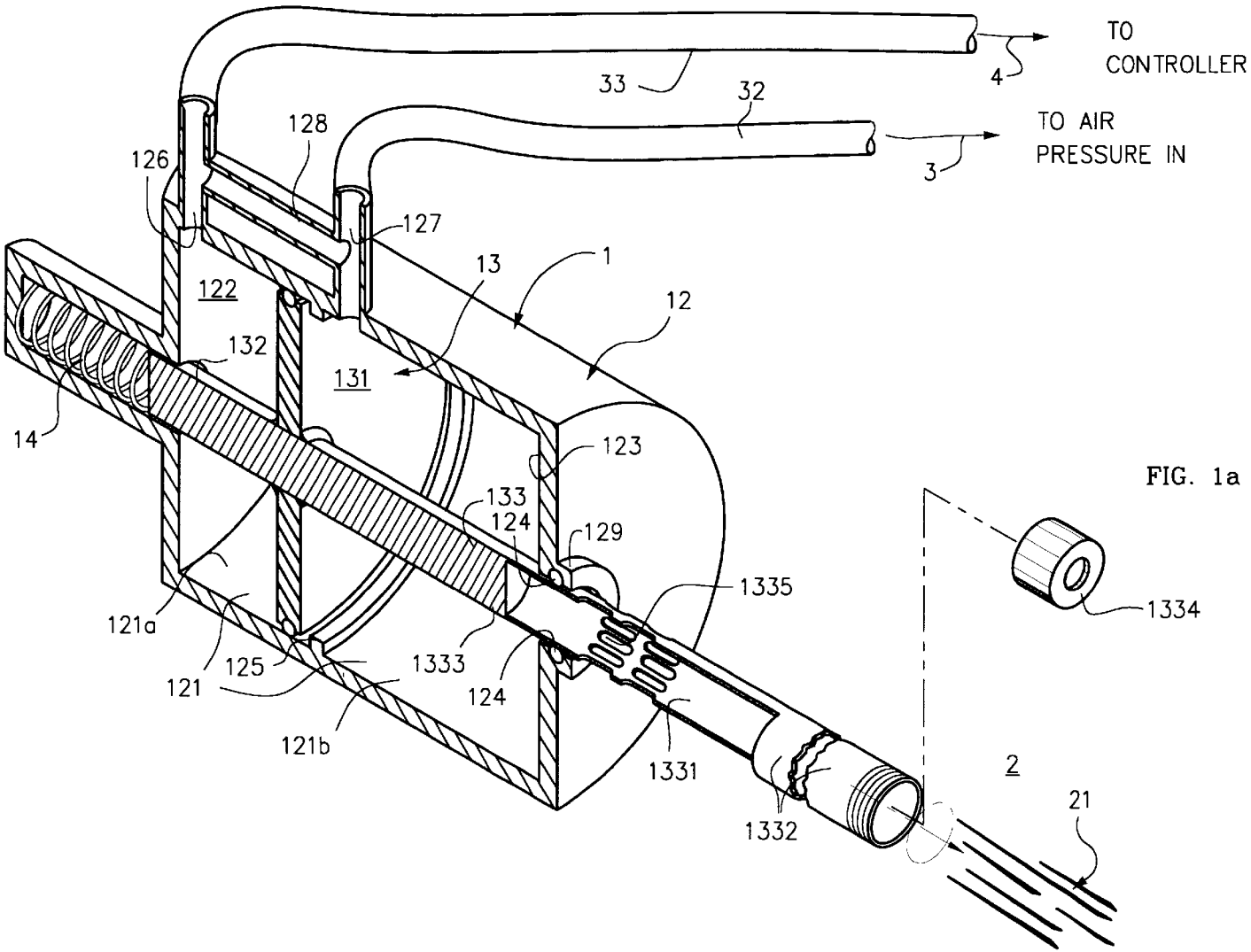
FIG. 1*a* is a cut-away diagrammatic perspective view showing a first embodiment of a prime mover device in accordance with the present invention.

1. Structure of an Immersible Prime Mover Device in Accordance With the Present Invention A first preferred embodiment of an immersible prime mover device 1 in accordance with the present invention is shown in FIG. 1. The device 1 is commonly completely immersed in a fluid, normally water, 2. It operates to periodically, or sporadically, eject a slug of water 21.

The device 1 is useable with, and powered from, an external source 3 (not shown) of compressed gas, commonly compressed air labeled as TO AIR PRESSURE IN hose 32. The source 3 of compressed air may be, by way of example, an air compressor located in air on land as suggested by AIR PUMP 41; shown in FIG. 4. When a compressor is used, it normally employs—as is universally conventional—a high pressure cut-off switch, making that it will only run to supply compressed air at its output until a predetermined (high) pressure is obtained. This function is not normally invoked by the present invention. However, it should be understood that any external source 3 of compressed air will under no circumstances supply air under such pressure to the prime mover device 1 as could cause the device 1 to explode.

The source 3 flow communicates compressed air to the immersed prime mover device 1 by the hose 32. The source 3 of compressed air may alternatively be an air storage tank, as is suggested by the scuba tank 81 shown in FIG. 8. Such an air storage tank which may be located in the air or submerged. All flow rates, pressures, accumulated volumes, discharge cycle rates, etc., etc, for the prime mover device 1 are completely arbitrary in accordance with the application in which it is employed. Normally, however, the prime mover device 1 is made of metal, typically stainless steel or brass. The pressure of the compressed air supplied is commonly 1–200 P.S.I., and is more commonly the approximate 90–150 PSI derived from a standard garage, or painting, air compressor—as besuits many applications of the prime mover device 1. The flow rate is not critical, and may occasionally be quite low as is typical of, by way of example, the auxiliary air pumps commonly sold to be powered by a 12 v.d.c. automotive electrical system to inflate, over the course of some minutes, and automobile pneumatic tire.

Figure 2:
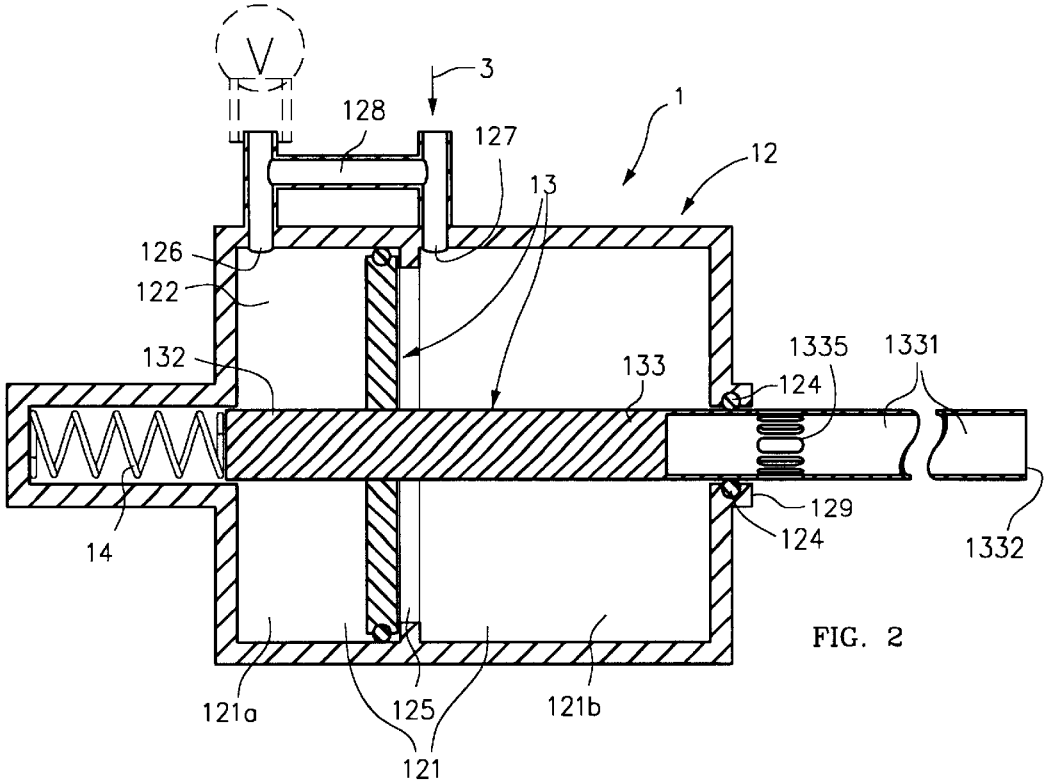
FIG. 2 is a cut-away side plan view of the first preferred embodiment of a prime mover device in accordance with the present invention, previously seen in FIG. 1, in its quiescent operational state.
Figure 3:
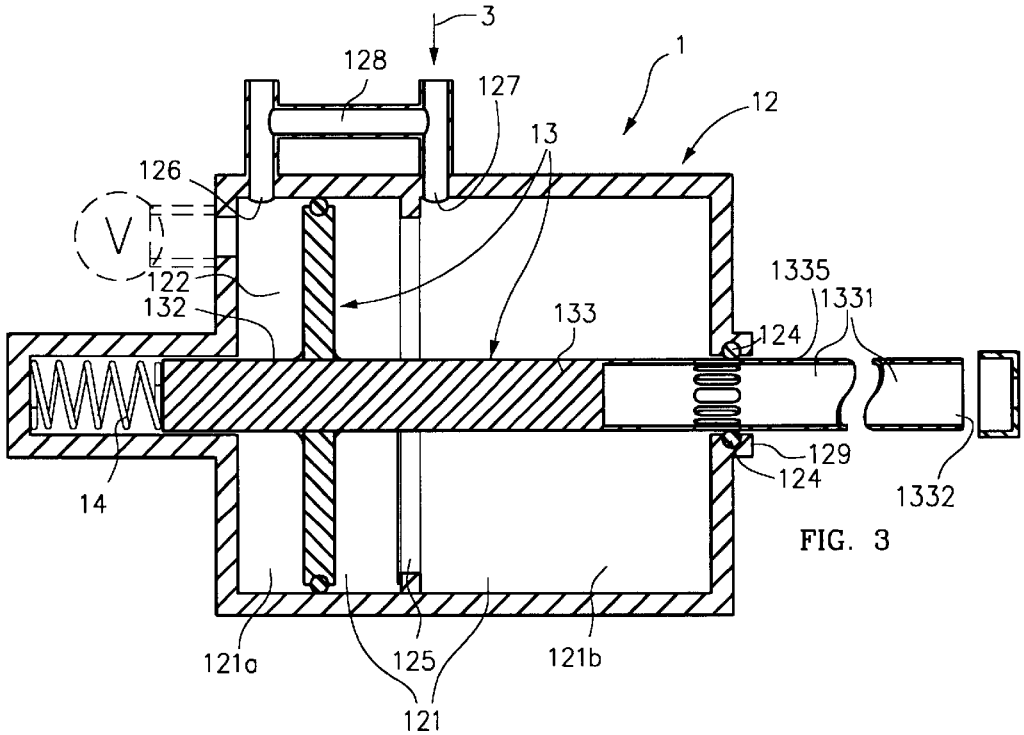
FIG. 3 is a cut-away side plan view of the first preferred embodiment of a prime mover device in accordance with the present invention, previously seen in FIGS. 1 and 2, during its operational state where gas, and a water slug, are both being discharged.

Compressed air accumulated in the embodiment of the prime mover device 1 shown in FIG. 1 is, as will be explained, occasionally vented through, and by, a gas flow gating device, or controller 4 (not shown). The controller 4 may be mechanical, or electrical, or even manual in the form of a simple hand valve. Its simple function is simply to, at a time or at times, momentarily vent air through the TO CONTROLLER hose 33 from the prime mover device 1 to, typically, the atmosphere. The controller 4 thus performs a function similar, or equivalent, to a relief valve 11 which, as will be shown in FIGS. 2 and 3, is there so shown in dashed line precisely because its venting function need not invariably be implemented as the there-shown form (i.e., as a relief valve) at the there-shown location (i.e., immediately on the side of chamber 12). In other words, the pressure relief can transpire through the TO CONTROLLER hose 33 and action of the controller 4, shown in FIG. 1, or by action of the relief valve 11 shown in FIGS. 2 and 3, or by still other means. The concept is simply that accumulated pressurized air in one portion (a first portion 121*a*) of the chamber 121 of the prime mover device 1 must be vented for the device to function. Whether this venting is to be considered as innate to the device 1 itself (as suggested by the relief valve 11 of FIGS. 2 and 3) or if it is external to the device in its environment (as is suggested by FIG. 1) is merely a matter of semantics. A practitioner of the air handling arts will recognize that there are many ways that the pneumatic communications of the prime mover device 1 of the present invention can be realized.

The prime mover device 1 has a hollow housing 12 defining an internal chamber 121 in the substantial shape of a prism, normally a cylinder. The cylindrical chamber 121 has a longitudinal axis (located along, in the preferred embodiment, the axis of the elongate members 132, 133 of the sliding element 13) and two end walls, or simply ends, 122, 123. The second end 123 of the cylindrical chamber 121 has and defines an orifice 124.

A spring 14 is affixed to the interior of the chamber 121 at its first end 122, which first end 122 is opposite to the chambers's second-end orifice 124. The spring 14 serves to forcibly bias anything with which it is in contact within the interior of the chamber to separation from the chamber's first end 122. The spring 14 in particular connects to, and biases in position, a sliding element 131. The sliding element 13 can be moved towards the chamber end wall 123 no further than the stop 125, normally implemented as a raised circumferential ring as shown.

The sliding element 13 is of complex form, but in the substantial shape of a (i) plate 131 with (ii) axial elongate members 132, 133 oppositely extending perpendicularly from each side of the plate 131. This sliding element 13 is located interior to the housing's chamber 121. When the chamber is cylindrical then the plate 131 is in the shape of an annular disk, as illustrated. The disk 131 is positioned transverse to the axis of the cylindrical chamber 121 so as to occupy a cross-sectional area of the chamber 121, dividing the chamber substantially airtight into two portions 121*a*, 121*b*.

A first-side axial elongate member 132 to the sliding element 13 normally extends longitudinally within a first portion 121*a* of the chamber 121 to contact the first-end spring 14. It is, of course, possible to make the spring 14 longer. Many means of force biasing the sliding element 13 in position will be known to a practitioner of the mechanical arts.

A second-side axial elongate member 133 to the sliding element 13 extends longitudinally oppositely in the second portion 121*b* of the chamber 121, and through the chamber's second-end orifice 124. The second-side axial elongate member so extends to an end, "exhaust", termination at a point normally well beyond the chamber's second-end interior (apertured) wall. This second-side elongate member is hollow, presenting an axial longitudinal cavity 1331, in at least a region proceeding from (i) its immersed open, exhaust, end 1332 at least so far as (ii) a point 1333 where, in certain operational conditions, the second-side elongate member 133 can be made to extend through the chamber's second-end orifice 124 and into the chamber's second portion 121*b*. This second-side elongate member 133 has at, and in, its circumference at a location longitudinally displaced from its exhaust end,. at least one hole, and normally an array of holes 1335, that flow connect its exterior to its hollow interior cavity 1331. The longitudinally-displaced location of these holes 1335 is, like the cavity 1331 itself, at least so far from the exhaust end 1332 as a point where, in certain operational conditions, the second-side elongate member 133 can be made to extend through the chamber's second-end orifice 124 and into the chamber's second portion 121*b*. The exhaust end may optionally be fitted with a selectable nozzle, or variably-occluding-tip, 1334.

Some small thought at this point about the above-stated definitions of the second-side axial elongate member 133, and its cavity 1331, and its at least one hole 1335, will reveal that, at some "certain operational conditions" yet to be defined, the second side axial elongate member 133 (and all of the sliding element 13 of which it forms a part) can be withdrawn so far within the chamber 121 that the at least one hole 1335 is exposed within the chamber's second portion 121*b*. This exposure will permit, for example, gas to egress (i) through the hole 1335 and (ii) along the axial longitudinal cavity 1331 and (iii) out the exhaust end opening 1332 into the fluid 2 in which at least this exhaust end opening 1332, and more commonly the entire prime mover device 1, is immersed. The geometries and sizes of the second-side axial elongate member 133, and the sliding element 13 of which it forms a part, fully support this egress.

Continuing with the structure of the prime mover device 1, the housing 12 also has and defines two ports 126, 127 at longitudinally spaced-apart positions.

Momentarily referencing FIGS. 2 and 3, in the embodiment shown therein a relief valve 11 is located between (i) the exterior of the housing 12 and (ii) the first portion 121*a* of its interior chamber 121. This relief valve 11 may be ported directly into the first portion 121*a* of chamber 121 as shown in FIGS. 2 and 3, or may equivalently be indirectly ported into the: same first portion 121*a* of the chamber 121 through the port 126 as shown in FIG. 1 when it is remembered that the function of the relief valve 11 may be realized by the port 126 flow connection through TO CONTROLLER hose 33 to the controller 4 (not shown). It makes no difference how the pressure relief is had—by action of relief valve 11 of FIGS. 2 and 3 or by action of the controller 4 (not shown, flow path through TO CONTROLLER hose 33 shown) of FIG. 1. In each case the gas flow path serves to quickly and substantially vent gas from the first portion 121*a* of the chamber 121 upon a threshold pressure being exceeded. After then venting, and when a lower pressure has been achieved in the first portion 121*a* of the chamber 121, then the relief valve 11 (of FIGS. 2 and 3), or the controller 4 (of FIG. 1), will reset shut.

Figure 1B:
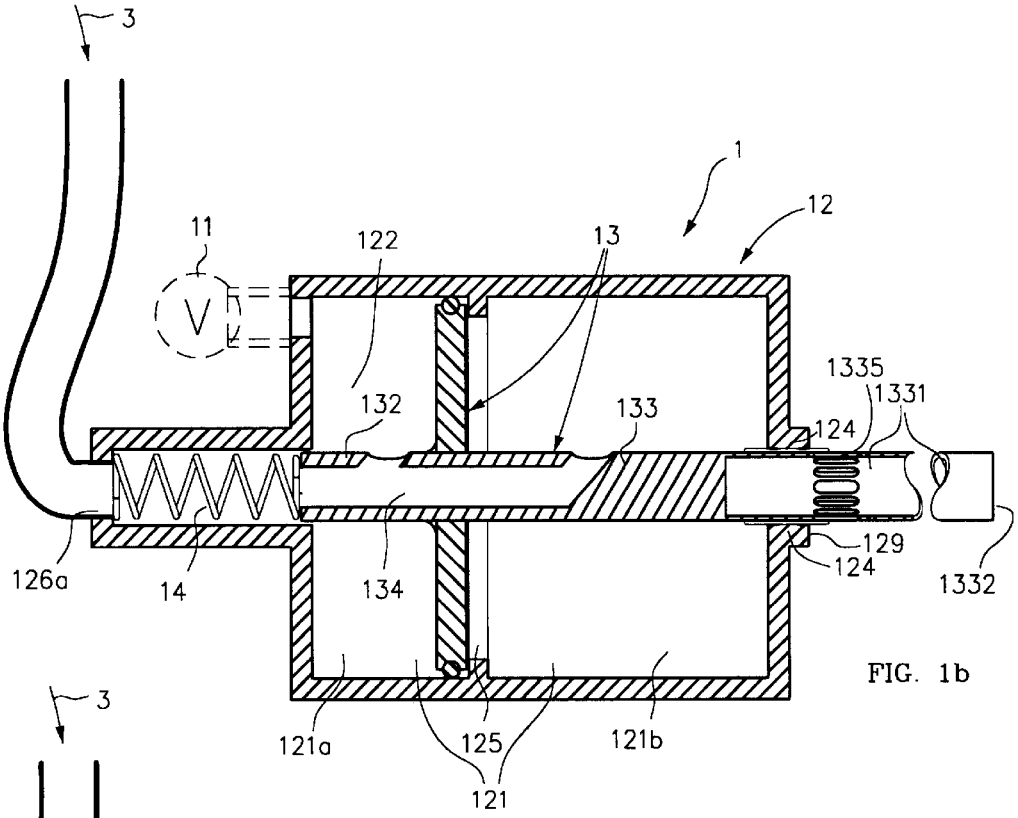
FIGS. 1*b* and 1*c* are cut-away side plan views respectively showing a second, and a third, embodiment of the prime mover device in accordance with the present invention that was previously seen in FIG. 1*a*.
Figure 1C:
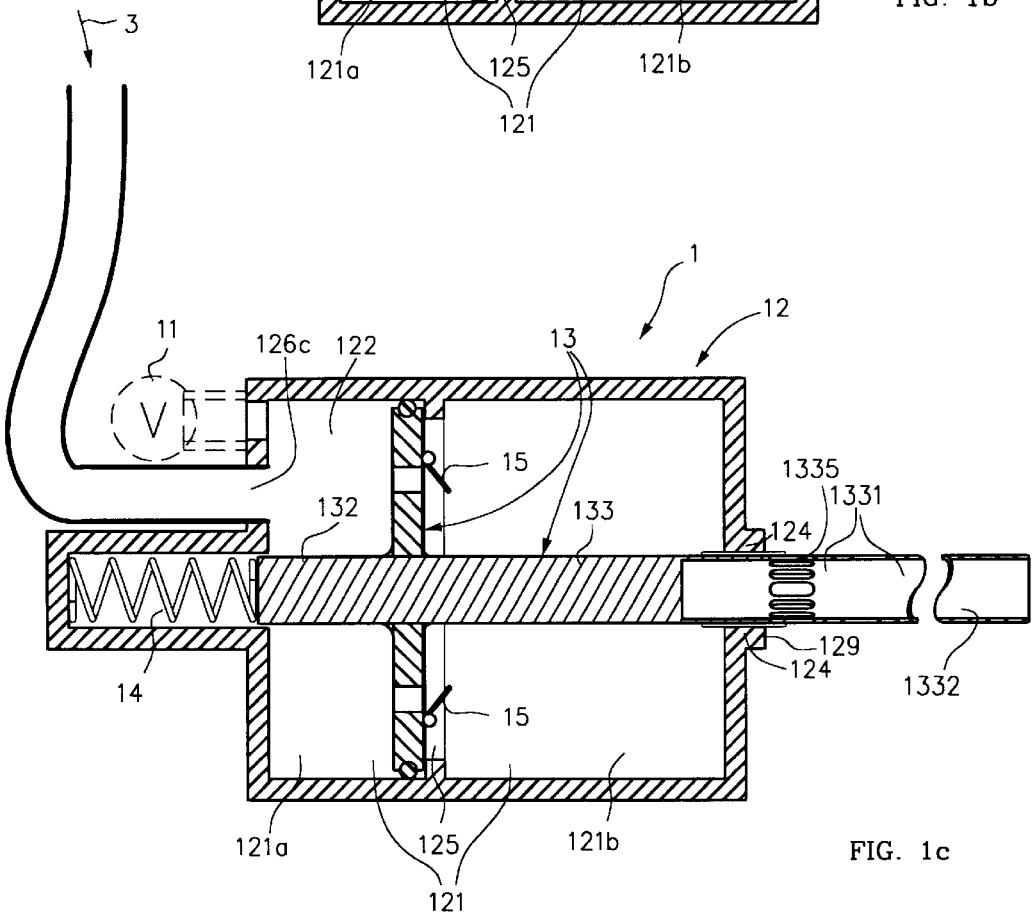

Further variant embodiments of the prime mover device in accordance with the present invention are shown in FIGS. 1*b* and 1*c*.

In the second embodiment of FIG. 1*b* the port 126 flow connection of the first embodiment (reference FIG. 1*a*) is replaced by the single aperture 126*a* through the housing 12. This aperture 126*a* flow connects into the first-portion 132 of the elongate member 13 where now exists an internal bifurcated channel 134. This bifurcated channel 134 extends both within both the first-portion 121*a* of the chamber 121 and, in regions where the hollow 1331 of the elongate member 13 is not, the second-portion of the elongate member 13. The bifurcated channel 134 flow-communicates gas received from the external source of compressed gas into both portions 121*a*, 121*b* of the chamber 121.

In the third, embodiment of FIG. 1*c* an aperture 126*c* through the housing 12 again flow connects directly to the first portion of the chamber. A one-way valve 15 in the plate 131 of the sliding member 13 flow communicates compressed gas from the first portion 121*a* of the chamber 121 to the second portion 12*b* of the chamber 121, as is necessary to build gas pressure in the first portion 121*a* for operation of the prime mover device 1.

2. Operation of an Immersible Prime Mover Device in Accordance With the Present Invention The operation of the prime mover device 1 can best be understood by. reference to FIGS. 2 and 3 where, by way of example, the first embodiment of FIG. 1 is illustrated.

In an initial operational state the spring 14 force biases the sliding element 13 in position so that its plate, or disk, 131 is positioned between the spaced-apart ports 127, 126, and against the stop 125, serving to make that compressed gas flow-communicated through the two ports 125, 126 should flow into each of the housing's internal chamber's two portions 121*a*, 121*b*. At this time the at least one circumferential hole 1335 of the hollow-interior second elongate member 131 is located outboard of the interior wall 123 of the second portion 121*b* of the interior chamber 121. Likewise the relief valve 11 is closed (or, equivalently, the flow path TO CONTROLLER shown in FIG. 1 is closed at the controller 4).

Little or no air gets out of the chamber anywhere. There is insubstantial leakage occurring, in particular, through the secondend orifice 124 to the chamber 121, which orifice 124 is plugged substantially airtight by the second elongate member 133 extending there through. If desired an optional circumferential seal, or O-ring, 129 (best seen in FIG. 1) may be used at this junction. Air simply accumulates in both the first portion 121*a* and second portion 121*b* of the chamber 121. In accordance with the laws of gas physics, and the connection 128 between the ports 127; 126 as is best seen in FIG. 1, the air pressure is both portions 121*a*, 121*b* is equal. No mechanical movement transpires anywhere within the prime mover device 1.

Air may thus be progressively accumulated in the chamber 121 under pressure for, depending upon the pressure of the source 3 and the sizes of the ports 127, 126 and the volume of the chamber 121, a considerable period of time. Ultimately, the air pressure within the chamber 121 rising to exceed the threshold pressure of the relief valve 11 (shown in FIGS. 2 and 3; alternatively a gas gating event occurring at controller 4 shown in FIG. 1), the relief valve 11 will trigger (alternatively, the controller 4 shown in FIG. 1 will commence to gate air through the hose 33 TO CONTROLLER. Compressed air will then be vented from the first portion 121*a* of the chamber 121 into the surrounding fluid 2, or wherever. Some air may attempt to flow, or may actually flow, from, (i) the second portion 121*b* of the chamber 121 out the gas port 127 that is flow-communicative with this second portion 121*b*, (ii) across the connection path 128, and (iii) into the gas port 126 that is flow-communicative with the first portion 121*a* of the chamber 121 (which first portion 121*a* is then being vented). Furthermore, if the source 3 of compressed air is not turned off, which it need not be and normally is not, then some compressed air from (ii) the source 3 of compressed air will still enter the first portion 121*a* of the chamber 121 (through the associated port 126) even while this first portion 121*a* is being vented. Finally, some compressed air may bypass the edges of the plate 131 (of the sliding element 13) which divides the chamber 121 into the two portions 121*a*, 121*b*, and may pass from (iii) the chamber's second portion 121*b* into its first portion 121*b*. There is preferably a seal, or O-ring, 129 between the edge, or circumference, of the plate, or disk, 131 and the interior wall of the chamber 121; however, this is not absolutely necessary. Importantly, all these compressed air leakages are normally small, insignificant, and completely harmless. The gas (air) ports 127, 126 by which both chamber portions 121*a*, 121*b* are filled are normally small in relation to the opening through which the relief valve 11 vents the chamber's first portion 121*a*. But little air can come into the chamber's venting first portion 121*a* through this route. The source 3 of compressed air supplies air at a rate that is much, much less than the rate at which it is vented: but little air can come into the chamber's venting first portion 121*a* through the port 127. Finally, air leakage past the plate 131 from the second portion 121*b* of the chamber 121 to its venting first portion 121*a* is insignificant: but little air can come into the chamber's venting first portion 121*a* through this route. Normally, and as a "rule of thumb", the rate of flow of air from each of these sources is less than one-tenth (1/10), and is normally less than one-hundredth (1/100), the rate of gas flow out the opened relief valve 11.

Instead, the opening of the relief valve 11 (shown in FIGS. 2 and 3; equivalently, a gating of gas through the controller 4 shown in FIG. 1) causes a strong immediate pressure differential across the plate 131, forcibly moving the sliding element 13 (of which the plate 131 forms a part) towards the first end 122 of the chamber. The spring 14 is compressed against the first-end elongate member 122, and against the sliding element 13 (of which the first-end elongate member 132 forms a part). When the sliding element 132 is stopped against the spring, then its plate 131 is normally still positioned between the spaced-apart ports 127, 126. Reference FIG. 3.

A great change in gas flow occurs, however, resultantly to this minor movement. The sliding movement of the sliding element 13 causes its second-end hollow elongate member 133 to be pulled 10 inward through the chamber's orifice 124 sufficiently far so that its one or more holes 1335 are drawn within the (second portion 121*b* of the) chamber 121. This hole (these holes) 1335, and the hollow interior of the second-end elongate member 133 to which they connect, are collectively of large area—typically even larger than the opening through which gas is vented from the chamber's first portion 121*a* via the relief valve 11. The compressed gas within the chamber's second portion 121*b* is substantially entirely immediately expelled through the second-end elongate member 133's one or more holes 1335, along the axial cavity 1331 of the second elongate member 133, out the second-end elongate member 133's exhaust end opening 1332 and into a fluid 2 within which this exhaust end opening 1332 is immersed.

Importantly, prior to this expulsion, a column of fluid 2 had accumulated in. the open-ended cavity 1331 of the second elongate member 133. The rapid expulsion of compressed air (from the chamber's second portion 121*b* though the exposed one or more holes 1335 into the cavity 1331) forces this accumulated fluid column as a slug from out the exhaust end opening 1332 of the second elongate member 133. This slug is forcibly expelled into fluid 2, providing a thrusting force impulse. The thrusting force acts along the entire axial length of the sliding element 13, through the stop against the spring 14 in the chamber 121, and into the housing 12, producing a force upon the entire device 1 which, by dint of this action, is properly called a "prime mover".

At such later time as most compressed air has been expelled from the second chamber 121*b* as well as the first chamber 121*a*, thus substantially equalizing pressure forces between the chambers 121*a*, 121*b*, then under force of the spring 14 the sliding element 13 will return to its quiescent position, therein permitting that continuing ingress of compressed gas from the external source 3 through the gas ports 127, 126 will ultimately accrue within the chamber 121 to re-enact the entire cycle all over again.

The only moving part of the prime mover device 1 is its sliding element 13 (its internal spring 14 also being compressed and released) or, if the relief valve 11 also is considered to be part of the device—and it need not invariably be so considered the sliding element 13 and the relief valve 11. The relief valve 11 is itself typically a spring-loaded device (spring not show). Each of these elements is energy efficient: not much energy is lost in the compression, and release, of a spring. The energy lost in venting compressed gas from the first portion 121*a* of the chamber 121 is basically stored in the internal spring 14. Accordingly, substantially all of the energy within the compressed gas supplied to the prime mover device 1 goes to producing the thrust impulse.

It should be understood that merely forcing a jet of gas into water—such as is not done in the present invention—can be inefficient (i) because the gas is of lessor density than the water, and/or (ii) insofar as the water is laterally displaced, forming a giant "bubble" instead of a cylindrical "jet". In accordance with the preferred embodiment of the invention, the hollow cavity 1331 of the second elongate member 133 is extended well outside the chamber (as illustrated), and fills with a slug of water between cycles of expulsion. When the compressed gas is vented from the chamber's second portion 121*b*, then this slug of water from the hollow second elongate member 133 is directed straight into the surrounding water 2, producing a highly directional water-against-water force that is highly efficient to produce thrust.

The second and third embodiments of FIGS. 1*b* and 1*c* function commensurately.

3. Applications of an Immersible Prime Mover Device in Accordance With the Present Invention The immersible prime mover device 1 in accordance with the present invention forcibly expels water in impulses.

The impulses may be of predetermined force as is determined mostly by the volume of the prime mover and its operating pressure, i.e., the threshold pressure at which the pressure relief valve triggers. The pressure relief valve, which has an occluding element that moves off a seat against the force of a simple spring, may be provided with a screw so as to adjust upwards and downwards (within the safety range of the housing's chamber) the threshold pressure (differential) at which triggering, and also reset, will occur. Notably, these simple adjustments can be made in the environment(s) of, and at the time(s) of, use.

The impulses may be of controlled frequency as is determined mostly by the volume of the prime mover and the rate of the flow of pressurized air. It is also possible to change the size of the ports to the housing's chamber. Notably, adjustment in the rate (volume per unit time) of air flow, and/or in any restriction(s) to this air flow, can also be made in the environment(s),and at the time(s), of use.

Accordingly, a prime mover device 1 in accordance with the present invention is adjustable in the magnitude, and in the frequency, of the thrusting force impulses that it produces.

3.1 Underwater Applications—A Swimming Pool Cleaner

One use for the prime mover device of the present invention is as the motive means of the scavenging head of a bathing basin, or swimming pool, cleaner as illustrated in perspective view in FIG. 4, and it cut-away side plan view in FIG. 4*a* and in top play view in FIG. 4*b*. The preferred swimming pool cleaner head 42 is connected by an air hose 43 to an air compressor 41 that is typically located alongside the pool (not shown). The air compressor 41 is typically electrically powered.

The preferred swimming pool cleaner head 42 is in the substantial shape of a wedge with a separate prime mover device 1 at each side, normally near a front side corner. The two prime mover devices 1 may be plumb connected to share a common relief valve 11 (not shown in FIG. 4, shown in FIGS. 2 and 3), and will thus cycle at the same times. Each may alternatively have its own pressure relief valve.

A bumper 42*b* is presented to the fore of the pool cleaner head 42. The compressed air may be communicated from a connective hose 43 within a hollow frame of the pool cleaner head 42 to the prime movers 1. If so, some minute amount may be bled off to create downward-directed air jets at the front which can help serve to dislodge, and to float, debris.

The preferred swimming pool cleaner head 12 makes good, and synergistic, use of the air bursts periodically liberated from the prime mover devices 1. In the preferred embodiment, a neutral buoyancy, water-filled, internal scavenging chamber shaped something like the catcher of a reel-type lawn mower serves to define the wedge shape, typically by stretching fabric over a plastic or metal frame. The scavenging chamber rises to an internal ledge 421, which falls off into sump 422.

When the water expulsion from either, or from both, of the co-controlled pair of prime mover devices 1 (i.e., the two separate prime mover devices 1 that are plumb-connected to share a common relief valve, and are thus cycling at the same times), is vented against the pool bottom or sides (not shown), then pool debris (not shown) is stirred up from the bottom, agitated in turbulent water, and momentarily mixed with air. This is a very good combination for lifting, at least momentarily, even stubborn debris and other contamination off the surfaces of the pool where it has collected.

The loosened debris, which typically momentarily gains buoyancy from the air bubbles, is floated upwards and, with the forward-thrusting movement of the entire cleaner head 42, rearward and over the barrier 421 in the scavenging bag, collecting at the rear top. Ultimately, over the course of minutes and of hours, the debris loses buoyancy, and sinks downward into the sump 422 of the scavenging bag. The entire cleaner head 42 including the scavenging bag is periodically lifted out of the pool and the scavenging bag emptied of debris.

3.2 Underwater Applications—A Propulsion Unit for a Boat

Figure 5:
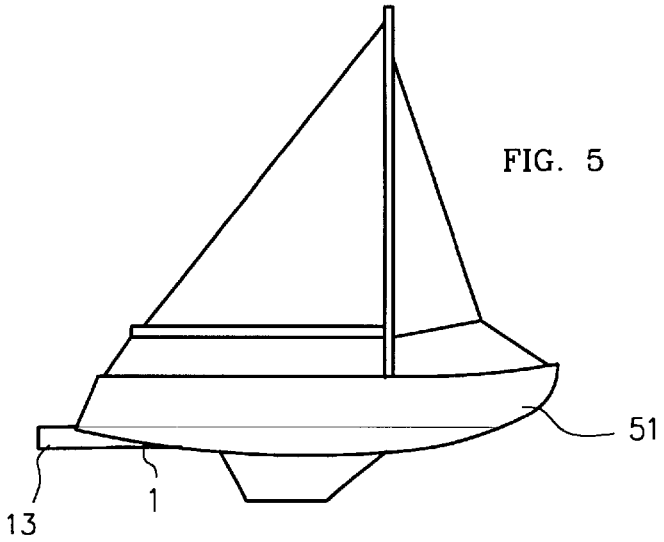
FIG. 5 is a diagrammatic perspective view showing one attachment of a prime mover device in accordance with the present invention to a sailboat for use as auxiliary propulsion.
Figure 6:
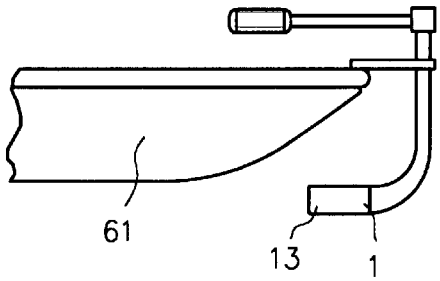
FIG. 6 is a diagrammatic perspective view showing one attachment of a prime mover device in accordance with the present invention to a fishing boat for use as a trolling motor.

Another use for the prime mover device of the present invention is as the propulsion unit of a boat. Application to a sailboat 51 is illustrated in FIG. 5, and to a small row boat, or fishing boat, 61 in FIG. 6. The prime mover device 1 is particularly suitable to propel either boat for trolling during fishing.

In the application to the sailboat 51 (shown in FIG. 5), the prime mover device is typically mounted at the stern.

In the application to the row boat 61 (shown in FIG. 6), the prime mover device may be mounted at the stern, or may be mounted in the style of an outboard motor. A prime mover device 1 so mounted is typically rotationally so mounted so as to be directionally pointed relative to the axis of the boat by manipulation of a tiller 611 or the like. Compressed air is provided to the prime mover 1 through an air hose either from (i) an air compressor that is typically electrically powered by a battery, or (ii) the compressed air of a scuba tank (not shown).

The prime mover device provides a periodic forward impetus that moves the boats 51, 61 typically but slowly in spurts and in spasms, which is useful in fishing. Namely, the occasional forward thrust imparted to the boats 51, 61 causes such movement in fish bait trailed behind the boats as causes this bait to more realistically emulate the pulsing movement of actual marine food sources, and to attract fish bites. (The principle is well known to fisherman.)

Second, it is believed that the sound produced by the prime mover device 1 attracts the attention of fish. It is even contemplated that "fish calls" attached to the prime mover device's outlet opening 1332 (reference FIG. 1) could adapt the pressure wave, or underwater sound, produced to more closely emulate actual maritime occurrences, further heightening the appeal to fish.

3.3 Underwater Applications—A Propulsion Unit for a Scuba Diver

Figure 8:
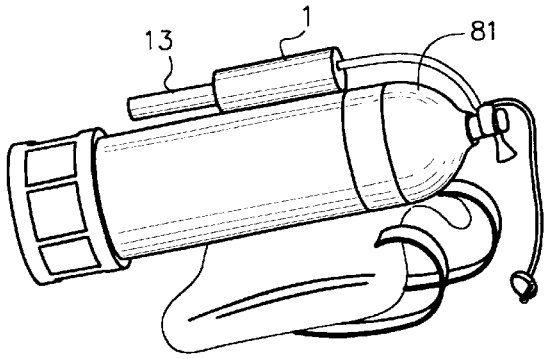
FIG. 8 is a diagrammatic perspective view showing a prime mover device in accordance with the present invention in use as propulsion for a scuba apparatus.

Referring to FIG. 8, a simple and compact, but potentially high pressure version of the prime mover device 1 of the present invention—which device 1 thus produces a powerful thrusting force—may be used attached to the tank or harness 81 of a scuba diver (not shown), and supplied under diver control with air from his/her scuba tank. A strong force, normally in individual burst, may be selectively generated to free a driver from entangling plants, or to escape undertow or turbulence. The propulsion force may be used by Navy seals or like underwater military personnel to escape hazard. Conversely, the prime mover may used simply for fun, especially in making recreational use of remaining air in a nearly spent scuba tank that must be refilled anyhow.

In this application the mechanism of the prime mover 1 is simple, lightweight, reliable and safe.

3.4 Land-Base Applications—A Water Cannon

Figure 9:
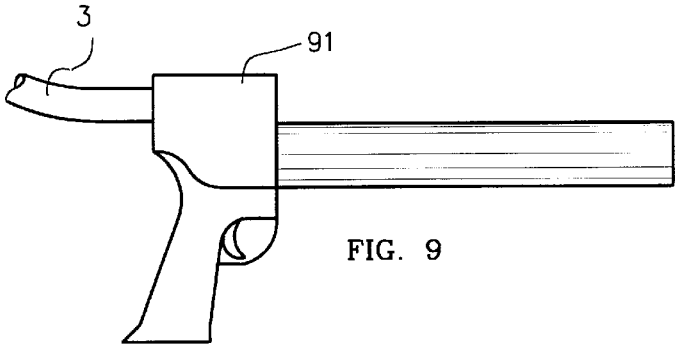
FIG. 9 is a diagrammatic perspective view showing a prime mover device in accordance with the present invention in use as a water cannon, or a gun, or a hydro-pneumatic jackhammer, or a toilet-bowl-unplugger-pipe-cleaner.

Referring to FIG. 9, a diagrammatic perspective view showing a prime mover device in accordance with the present invention in use as any of a water cannon, or a gun, or a hydro-pneumatic jackhammer, or a toilet-bowl-unplugger-pipe-cleaner is shown. The body 91 of the prime mover device is held, potentially by aid of trigger-activated pistol grip, to discharge of water slug from the barrel.

Figure 7:
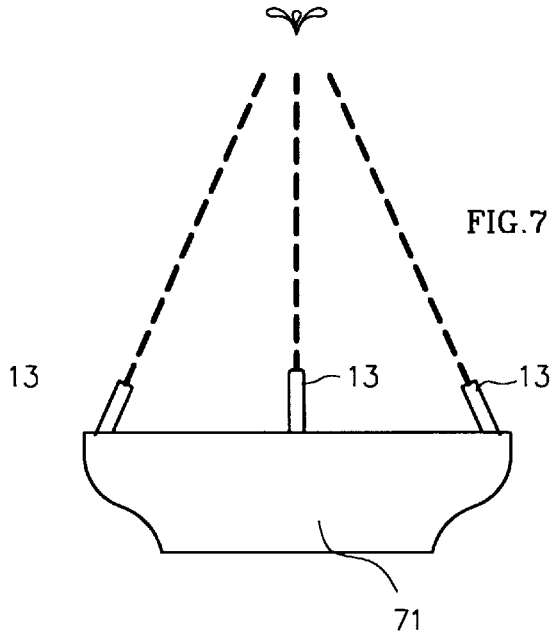
FIG. 7 is a diagrammatic perspective view showing a transient "snapshot" of fountain using a prime mover device in accordance with the present invention as a generator of water. pulses.

The prime mover device 1 of the present invention may be used to good effect on land. At least the hollow second-end elongate member 133 is normally permitted to fill with water in its cavity 1331. Water expelled from this elongate member 133, and from the prime mover 1, may serve as a slug of water in a pulsating fountain 71 as shown in FIG. 7, or in the water cannon or like devices as shown in FIG. 9.

At large and/or powerful scales of the prime mover device 1, expelled pulses of water or other liquids such as de-icer or detergent may be used for purposes such as the breaking of ice, or the washing of vehicles.

In a smaller and simpler embodiment, it is possible to position a prime mover to clean clogged drains and toilet bowls. The prime mover device is positioned in water over the clogged drain or toilet bowl, and forcibly held. It is charged with air through a hose from a foot-operated air pump, or a bicycle pump, or an air tank or the like. When the prime mover discharges while held in place, a powerful shock wave is generated directionally in the fluid, potentially dislodging a clog.

3.5 Underwater Applications—A Propulsion Unit for an Aquatic Maneuvering Unit

Figure 10:
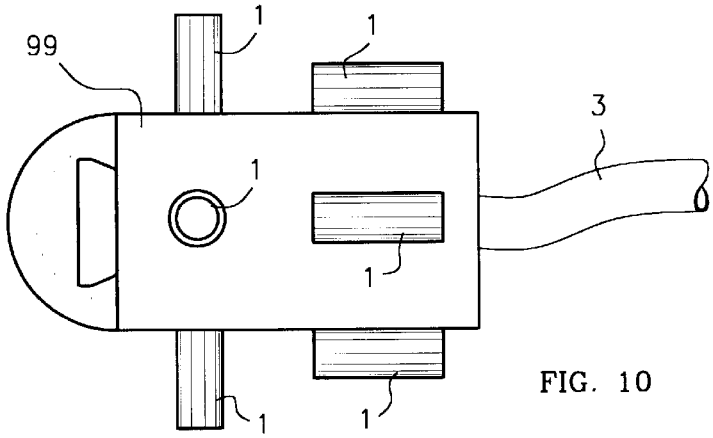
FIG. 10 is a diagrammatic perspective view showing a prime mover device in accordance with the present invention in use as an aquatic rescue board with air tank.

FIG. 10 is a diagrammatic perspective view showing attachment of a large number (five are illustrated) of prime mover devices in accordance with the present invention to a an aquatic maneuvering unit for use as propulsion. A diver holds the unit, including by grabbing extending tubular portions of the prime movers, and controls, by switches of the like, the incidence, frequency, direction and/or magnitude of propulsive forces generated.

Referring to FIG. 10, a prime mover device 1 in accordance with the present invention in use as a general-purpose air-hose-connected aquatic maneuvering unit 99 is shown.

Multiple prime mover elements 1 are mounted to the maneuvering unit 99 in which may be contained an air tank (not shown), or to which may be supplied compressed gas through an air hose 3. A skin diver or like person manually operates one or more of the prime movers 1 as and when desired for imparting propulsion to the unit 99, and to himself/herself.

3.5 Underwater Applications—A Propulsion Unit for a Surfboard or Rescue Board

Figure 11:
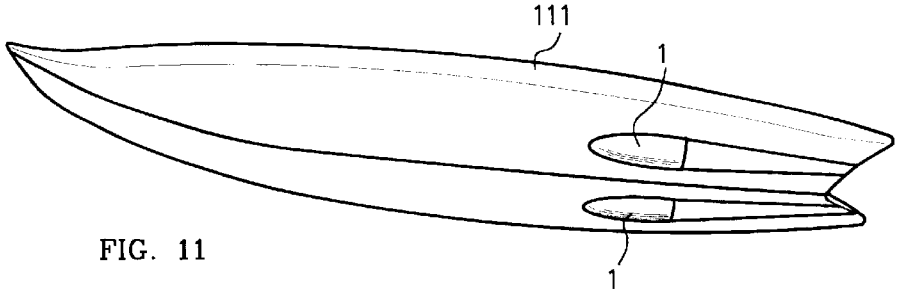
FIG. 11 is a diagrammatic perspective view showing attachment of a pair of prime mover devices in accordance with the present invention to a surfboard, or rescue board, or swimmer's aid for use as auxiliary propulsion.

FIG. 11 is a diagrammatic perspective view showing attachment of a pair of prime mover devices in accordance with the present invention to a surfboard, or a rescue board, or a lifeguard's buoy, for use as auxiliary propulsion.

Referring to FIG. 11, a prime mover device 1 of the present invention may be used attached to a surfboard 111, and supplied under surfer control with air from, most typically, a scuba tank (located on top of or within the surfboard 111, not shown in FIG. 11). A force may be selectively generated, normally in bursts at surfer-controlled times, to help propel the surfboard, such as through breaking waves in paddling out to surf. Alternatively, the "power assist" may be used more extensively by those so desiring, creating a "power surfboard".

In accordance with the preceding explanation, variations and adaptations of the prime mover device 1 in accordance with the present invention will suggest themselves to practitioners of the pneumatic and pneumatic tool arts. For example, several of the prime mover devices 1 could be arrayed in parallel, or in series, and operated together, or separately in stages, for differing propulsion and expulsion effects.

In accordance with these and other possible variations and adaptations of the present invention, the scope of the invention should be determined in accordance with the following claims, only, and not solely in accordance with that embodiment within which the invention has been taught.

What is claimed is:

1. A compressed-gas-powered immersible prime mover device useable with an external source of compressed gas, the device comprising:

a housing defining a chamber accumulating compressed gas from the external source of compressed gas, the chamber having an orifice;

a piston sliding within the chamber so as to divide the chamber into two variable portions;

an open-ended tubular member, affixed to the sliding piston for sliding therewith to a variable extension through the housing's chamber's orifice, having at least one circumferential hole between an interior and an exterior of the tube at a location along the member where the at least one hole is within, or without, the chamber depending upon the position of the sliding piston; and a pressure relief means for venting accumulated compressed gas from a first portion of the chamber so as to move the sliding piston within the chamber under force of a differential gas pressure across it, therein also moving the tubular member affixed to the sliding piston so that the at least one hole of the tubular member is pulled from the exterior to the interior of a second portion of the chamber, whereupon accumulated compressed gas stored within the second portion of the chamber does egress the- chamber through the at least one hole and through the tube of the member in which tube water has accumulated, thus strongly directionally ejecting this accumulation as a slug of water;

wherein the ejected slug of water provides motive force.

2. The prime mover device according to claim 1 further comprising:

a spring, located between (i) the housing and (ii) the affixed sliding piston and tubular member, storing up force during sliding movement of the sliding piston and, when the differential gas pressure force across the sliding piston is spent, thereafter serving so as to move the sliding piston and tubular member so that the at least one hole of the tubular member returns to the exterior of the chamber;

wherein the pressure relief valve is periodically venting compressed gas so that sliding piston and tubular member slide, under differential gas pressure and spring forces, cyclicly bi-directionally within the chamber, the slug of water being periodically ejected.

3. The prime mover device according to claim 1 wherein the pressure relief means comprises:

a controller of pressure.

4. The prime mover device according to claim 3 wherein the pressure controller is situated remotely from the prime mover device, and connected thereto by a hose.

5. The prime mover device according to claim 1 wherein the pressure relief means comprises:

a pressure relief valve.

6. A method of operating an immersed prime mover device so as to produce from compressed air an ejected slug of water, the method comprising:

porting gas from the external source of compressed gas to both portions of an immersed apertured chamber that is divided by a sliding piston affixing an open-ended hollow tubular member that extends through a second portion of the chamber and through an orifice to the chamber sufficiently far so that at least one sidewall hole in the tubular member is outside the chamber;

where the tubular member outside the immersed chamber fills with water from its at least one sidewall hole and its open end;

where equal gas pressure accrues in both chamber portions on both sides of the sliding piston, which does not move at this time;

where the chamber is substantially sealed gas tight because, other than any port through which gas is received, its only orifice is plugged substantially gas-tight by the tubular member; and then venting with a pressure relief valve accumulated compressed gas from a first portion of the chamber so as to cause a differential gas pressure force across the sliding piston, sliding both it and the tubular member to which it is affixed within the chamber so that the at least one sidewall hole of the tubular member, previously outside the chamber, is now drawn within the second portion of the chamber, permitting that accumulated compressed gas stored within this second portion of the chamber will egress the chamber through the at least one hole and through the tube of the member in which tube water has accumulated, thus strongly directionally ejecting this accumulation as a slug of water;

wherein the ejected slug of water provides motive force.

7. The method according to claim 6 further comprising:

accumulating energy in a spring, located in a second portion of the chamber between (i) an end wall of the chamber and (ii) the sliding piston affixing the tubular member, during sliding movement of the sliding piston under differential gas pressure force; and then, when the differential gas pressure force across the sliding piston is spent by virtue of the egress of compressed gas from the second portion of the chamber, releasing energy from the spring to move the sliding piston and tubular member so that the at least one hole of the tubular member returns to the exterior of the chamber;

wherein the venting of compressed gas by the pressure relief valve is cyclical, making the sliding piston and tubular member to slide, under differential gas pressure and spring forces, cyclicly bi-directionally within the chamber, and causing the slug of water to be periodically ejected.

8. A compressed-gas-powered immersible prime mover device useable with an external source of compressed gas, the device comprising:

a hollow housing having an internal chamber in the substantial shape of a prism having a longitudinal axis and two ends, a second end of the chamber defining an orifice;

a spring means, affixed to the interior of a first end of the chamber opposite the chamber's second-end orifice, for forcibly biasing anything with which it is in contact to separation from the interior first end of the chamber;

a sliding element, interior to the housing's chamber, in the substantial shape of (i) a plate with (ii) an elongate member extending perpendicularly from each side, the sliding element's plate being positioned transverse to the prism's axis so as to occupy a cross-sectional area of the prism, dividing substantially airtight the volume of the housing's internal chamber into two portions, while a first-portion of the elongate member at a first side of the plate extending longitudinally into a first portion of the chamber to contact the first-end spring means, while a second-portion of the elongate member at a second side of the plate extends longitudinally oppositely into the second portion of the chamber and through the chamber's second-end orifice, this second-portion of the elongate member being hollow and defining a cavity in at least in the region from (i) its immersed open exhaust end to (ii) a point along the elongate member which can be made to become, should the second-side elongate member be maximally retracted into the chamber, positioned within the chamber, this second-portion of the elongate member having at its circumference, at a point at least so far from the exhaust end of the second-portion of the elongate member as can be made to become, should the second-portion of the elongate member be maximally retracted into the chamber, positioned within the chamber, at least one hole from its exterior to the cavity of its hollow interior; and a port means for flow communicating compressed gas from an external source of compressed gas into both portions of the chamber; and a relief valve means, located in a flow path between the exterior of the housing and the first portion of its interior chamber, for quickly and substantially venting gas from the first portion of the chamber upon a threshold pressure in the first portion of the chamber being exceeded, after which venting when a lower gas pressure is restored within the first portion of the chamber, the relief valve means will reset shut;

wherein in an initial operational state (i) compressed gas flow-communicated from the external source of compressed gas through the port means flows into each of the housing's internal chamber's two portions, while (ii) the at least one circumferential hole of the hollow-interior second elongate member is located outboard of that part of the second elongate member that is then within the chamber;

wherein upon continuing flow-communication of compressed gas from the external source through the port means equal pressures accrue in both portions of the chamber, with only insubstantial leakage occurring through the second-end orifice that is then plugged substantially airtight by the second elongate member extending there through;

wherein when the gas pressure exceeds the threshold pressure in the first portion of the chamber, then the relief valve means triggers to quickly and substantially vent gas from the first portion of the chamber so that a strong immediate pressure differential across the plate will forcibly move the sliding element towards the first end of the chamber, therein both (i) compressing the spring means and (ii) pulling the sliding element's second-end hollow elongate member inward through the chamber's orifice sufficiently far so that its hole is now drawn within the chamber;

wherein at such time as the sliding element has moved in position under force of the differential gas pressure across the plate the spring means becomes compressed, and the compressed gas of the second portion of the chamber is expelled through the second-end elongate member's hole, along the longitudinal cavity of the second-end elongate member, and out the open exhaust end of the second-end elongate member into a fluid within which second-end elongate member is immersed, providing a thrusting force impulse upon the entire device;

wherein at which later time as the compressed gas has been expelled from the second portion of the chamber as well as the first portion of the chamber, then under force of the spring means the sliding element will return to its quiescent position, permitting thereafter that continuing ingress of compressed gas from the external source through the port means will ultimately accrue within both portions of the chamber to produce the entire cycle all over again.

9. The prime mover device according to claim 8 wherein the port means comprises:

two ports, defined in and by the housing at longitudinally spaced-apart positions;

wherein in an initial operational state the spring means force biases the sliding element in position so that (i) the plate is positioned between the spaced-apart ports, making that (ii) compressed gas flow-communicated from the external source of compressed gas through the two ports flows into each of the housing's internal chamber's two portions, while (iii) the at least one circumferential hole of the hollow-interior second elongate member is located outboard of that part of the second elongate member that is then within the chamber;

wherein upon continuing flow-communication of compressed gas from the external source through both ports equal pressures accrue in both portions of the chamber, with only insubstantial leakage occurring through the second-end orifice that is then plugged substantially airtight by the second elongate member extending there through;

wherein when the gas pressure exceeds the threshold pressure in the first portion of the chamber, then the relief valve means triggers to quickly and substantially vent gas from the first portion of the chamber so that, although some gas will flow or attempt to flow from the second portion of the chamber out one flow-communicative gas port and into the gas port flow-communicating with the second chamber which is then being vented, a strong immediate pressure differential across the plate will forcibly move the sliding element towards the first end of the chamber, therein both (i) compressing the spring means and (ii) pulling the sliding element's second-end hollow elongate member inward through the chamber's orifice sufficiently far so that its hole is now drawn within the chamber;

wherein at such time as the sliding element has moved in position under force of the differential gas pressure across the plate, which remains positioned between the spaced-apart ports, the spring means becomes compressed, and the compressed gas of the second portion of the chamber is expelled through the second-end elongate member's hole, along the longitudinal cavity of the second-end elongate member, and out the open exhaust end of the second-end elongate member into a fluid within which second-end elongate member is immersed, providing a thrusting force impulse upon the entire device;

wherein at which later time as the compressed gas has been expelled from the second portion of the chamber as well as the first portion of the chamber, then under force of the spring means the sliding element will return to its quiescent position, permitting thereafter that continuing ingress of compressed gas from the external source through the ports will ultimately accrue within both portions of the chamber to produce the entire cycle all over again.

10. The prime mover device according to claim 8 wherein the port means comprises:

an aperture through the housing; flow connecting to a tube into the first-portion of the elongate member; flow connecting to a bifurcated channel within both the first-portion and, in regions where the hollow is not, the second-portion of the elongate member, the channel bifurcated to flow communicate gas received from the external source of compressed gas into both portions of the chamber;

wherein in an initial operational state (i) compressed gas flow-communicated from the external source of compressed gas through the aperture, the tube and the bifurcated channel flows into each of the housing's internal chamber's two portions, while (ii) the at least one circumferential hole of the hollow-interior second elongate member is located outboard of that part of the second elongate member that is then within the chamber;

wherein upon continuing flow-communication of compressed gas from the external source through the aperture, the tube and the bifurcated channel equal pressures accrue in both portions of the chamber, with only insubstantial leakage occurring through the second-end orifice that is then plugged substantially airtight by the second elongate member extending there through;

wherein when the gas pressure exceeds the threshold pressure in the first portion of the chamber, then the relief valve means triggers to quickly and substantially vent gas from the first portion of the chamber so that, although some gas will flow or attempt to flow from the second portion of the chamber into the bifurcated channel and through this channel to the second chamber which is then being vented, a strong immediate pressure differential across the plate will forcibly move the sliding element towards the first end of the chamber, therein both (i) compressing the spring means and (ii) pulling the sliding element's second-end hollow elongate member inward through the chamber's orifice sufficiently far so that its hole is now drawn within the chamber;

wherein at such time as the sliding element has moved in position under force of the differential gas pressure across the plate the spring means becomes compressed, and the compressed gas of the second portion of the chamber is expelled through the second-end elongate member's hole, along the longitudinal cavity of the second-end elongate member, and out the open exhaust end of the second-end elongate member into a fluid within which second-end elongate member is immersed, providing a thrusting force impulse upon the entire device;

wherein at which later time as the compressed gas has been expelled from the second portion of the chamber as well as the first portion of the chamber, then under force of the spring means the sliding element will return to its quiescent position, permitting thereafter that continuing ingress of compressed gas from the external source through the aperture, the tube and the bifurcated channel will ultimately accrue within both portions of the chamber to produce the entire cycle all over again.

11. The prime mover device according to claim 8 wherein the port means comprises:

an aperture through the housing flow connecting to the first portion of the chamber; and a one-way valve in the plate of the sliding member flow communicating compressed gas from the first portion of the chamber to the second portion of the chamber;

wherein gas received from the external source of compressed gas through the aperture into the first portion of the chamber further passes the one-way valve into the second portion of the chamber;

wherein in an initial operational state (i) compressed gas flow-communicated from the external source of compressed gas flows into each of the housing's internal chamber's two portions, while (ii) the at least one circumferential hole of the hollow-interior second elongate member is located outboard of that part of the second elongate member that is then within the chamber;

wherein upon continuing flow-communication of compressed gas from the external source through the aperture and the one-way valve equal pressures accrue in both portions of the chamber, with only insubstantial leakage occurring through the second-end orifice that is then plugged substantially airtight by the second elongate member extending there through;

wherein when the gas pressure exceeds the threshold pressure in the first portion of the chamber, then the relief valve means triggers to quickly and substantially vent gas from the first portion of the chamber while gas is substantially prevented from flowing from the second portion of the chamber into the first portion of the chamber by the one-way valve, a strong immediate pressure differential across the plate will forcibly move the sliding element towards the first end of the chamber, therein both (i) compressing the spring means and (ii) pulling the sliding element's second-end hollow elongate member inward through the chamber's orifice sufficiently far so that its hole is now drawn within the chamber;

wherein at such time as the sliding element has moved in position under force of the differential gas pressure across the plate the spring means becomes compressed, and the compressed gas of the second portion of the chamber is expelled through the second-end elongate member's hole, along the longitudinal cavity of the second-end elongate member, and out the open exhaust end of the second-end elongate member into a fluid within which second-end elongate member is immersed, providing a thrusting force impulse upon the entire device;

wherein at which later time as the compressed gas has been expelled from the second portion of the chamber as well as the first portion of the chamber, then under force of the spring means the sliding element will return to its quiescent position, permitting thereafter that continuing ingress of compressed gas from the external source through the aperture and the one-way valve to accrue within both portions of the chamber to produce the entire cycle all over again.

12. The prime mover device according to claim 8 operative with a source of compressed air.

13. The prime mover device according to claim 12 operative with compressed air from an air compressor.

14. The prime mover device according to claim 12 operative with compressed air from an air storage tank.

15. The prime mover device according to claim 8 wherein the prismatic chamber is in the substantial shape of a cylinder; and wherein the sliding element's plate is in the shape of a disk.

16. The prime mover device according to claim 8 further comprising:

a seal around the second-end elongate member where it passes and slides though the chamber's second-end orifice.

17. The prime mover device according to claim 8 further comprising:

a O-ring seal around the second-end elongate member where it passes and slides though the chamber's second-end orifice.

18. The prime mover device according to claim 8 in use under water to propel a marine device.

19. The prime mover device according to claim 18 in use under water to propel a marine device from the group consisting of floating marine devices including surfboards, rescue boards and floating aquatic maneuvering devices.

20. The prime mover device according to claim 8 in use at least partially above water to forcibly expel a slug of water from the cavity of its second-side hollow elongate member.

21. The prime mover device according to claim 20 in use to forcibly expel a slug of water from a water-expelling device from the group consisting of water-expelling fountains; and water-expelling water cannons.

22. A pool cleaner usable with an external source of compressed air comprising:

an enclosure, lying immersed on the bottom of a pool, defining a chamber (i) at least partially open at its bottom and closed on its sides and top, with (ii) a capture reservoir to the top rear;

wherein anything rising upwards, and flowing rearward, within the chamber will tend to become lodged within the capture reservoir; and a propulsion means, affixed to the immersed enclosure, for, (i) at a first time, accumulating compressed gas from the external source o compressed air within a chamber of the propulsion means concurrently that water is accumulated within an ejection tube of the propulsion means and, (ii) at a second time, venting the compressed gas accumulated within the chamber of the propulsion means into and out of the ejection tube, causing that a slug of water from the ejection tube is strongly directionally ejected under air pressure, causing the propulsion means and the enclosure to which it is affixed to move oppositely to the ejected water slug, capturing such debris from the bottom of the pool as may float upwards and rearward in the moving enclosure, becoming lodged in the capture reservoir.

23. The compressed-air-powered water-slug-ejecting pool cleaner according to claim 22 wherein the enclosure's capture reservoir comprises:

a bag attached at a top rear opening on the enclosure;

wherein anything rising upwards, and flowing rearward, within the chamber of the enclosure will tend to egress the top rear opening and, upon sinking again, become lodged within the bag.

wherein the bag may be manually emptied to remove debris from the pool.

24. The compressed-air-powered water-slug-ejecting pool cleaner according to claim 22 wherein the propulsion means comprises:

at least one compressed-gas-powered immersible prime mover device including a housing defining a chamber accumulating compressed gas it from the external source of compressed gas, the chamber having an orifice, a piston sliding within the chamber so as to divide the chamber into two variable portions, an open-ended tubular member, affixed to the sliding piston for sliding therewith to a variable extension through the housing's chamber's orifice, having at least one circumferential hole between an interior and an exterior of the tube at a location long the member where the at least one hole is within, or without, the chamber depending upon the position of the sliding piston, and a pressure relief means for venting accumulated compressed gas from a first portion of the chamber so as to move the sliding piston within the chamber under force of a differential gas pressure across it, therein also moving the tubular member affixed to the sliding piston so that the at least one hole of the tubular member is pulled from the exterior to the interior of a second portion of the chamber, whereupon accumulated compressed gas stored within the second portion of the chamber does egress the chamber through the at least one hole and through the tube of the member in which tube water has accumulated, thus strongly directionally ejecting this accumulation as a slug of water;

wherein the ejected slug of water provides motive force.

25. The compressed-air-powered water-slug-ejecting pool cleaner according to claim 24 wherein the propulsion means comprises:

two compressed-gas-powered immersible prime mover devices actuated in common through a common pressure relief means;

wherein movement of the pool cleaner head will be responsive to the vector sum of same-time propulsion forces from the two prime mover devices.

26. The compressed-air-powered water-slug-ejecting pool cleaner according to claim 24 wherein the propulsion means comprises:

two compressed-gas-powered immersible prime mover devices actuated separately each through its own pressure relief means;

wherein movement of the pool cleaner head will be responsive at times to one, and at times to the other, of the two prime mover devices.

27. The pool cleaner according to claim 22 operative with compressed air from an air compressor.

28. The pool cleaner. accord-.ing to claim 22 wherein the enclosure comprises:

a hollow space frame constituting a portion of a flow path through which compressed air is channeled from the external source of compressed air to the propulsion means.

29. The pool cleaner according to claim 28 wherein the hollow space frame comprises:

tubing;

and wherein the enclosure further comprises:

fabric upon the hollow tubular space frame.

30. The pool cleaner according to claim 28 wherein air is bled from the hollow space frame in order to stir up debris upon the bottom of the pool and temporarily impart such buoyancy thereto as tends to cause the debris to float upwards and rearward in the moving enclosure, ultimately again settling towards the bottom and becoming lodged in the enclosure's reservoir.

31. A pool cleaner usable with an external source of compressed air comprising:

an enclosure lying immersed on the bottom of a pool, the enclosure defining a generally wedge-shaped chamber lying upon one major surface of the wedge, the chamber being at least partially open at its bottom and closed on its sides and top, with a top rear opening;

a bag attached to the top rear opening on the enclosure;

wherein anything rising upwards, and flowing rearward, within the chamber will tend to egress the top rear opening and, upon sinking again, become lodged within the bag; and a combination propulsion and air-ejection means, affixed to the wedge-shaped immersed enclosure, for periodically directionally ejecting under pressure a slug of water and air so as to cause the enclosure to move forward in the direction of its wedge edge simultaneously that the ejected air and water both stirs up debris upon the bottom of the pool and temporarily imparts such buoyancy thereto as tends to cause the debris to float upwards and rearward in the moving enclosure, exiting the top rear opening and ultimately, when again settling towards the bottom, becoming lodged in the bag;

wherein the bag may be manually emptied to removes debris from the pool.

32. A propulsion system, usable with an external source of compressed air, for a watercraft, the watercraft propulsion system comprising:

a prime mover including a housing defining a chamber accumulating compressed gas from the external source of compressed gas, a sliding assembly dividing the chamber into two portions, and a pressure relief valve periodically venting a first portion of the chamber so as to move the sliding assembly within the chamber, the sliding assembly when moved letting all the compressed air stored within the second portion of the chamber egress the chamber through a tubular feature of the sliding assembly in which feature water is present, thus strongly directionally ejecting this water as a slug, wherein the ejected slug of water provides motive force; and a means for affixing the prime mover to the watercraft.

33. The propulsion system for a watercraft according to claim 32 wherein the means for affixing permits that the prime mover may be directed in angle relative to a longitudinal axis of the watercraft.

34. The propulsion system for a watercraft according to claim 32 wherein plural prime movers are affixed to the watercraft at positions to either side of a longitudinal axis of the watercraft; and wherein the propulsion system further comprises:

means for controlling each of the plurality of prime movers in order that, by a difference in motive force produced by each, the watercraft may be maneuvered.

35. An aquatic propulsion system usable with a scuba tank containing compressed air, the propulsion system comprising:

a housing defining a chamber accumulating compressed air from the scuba tank;

a sliding assembly dividing the chamber into two portions; and a pressure relief valve periodically venting a first portion of the chamber so as to move the sliding assembly within the chamber, the sliding assembly when moved letting all the compressed air stored within the second portion of the chamber egress the chamber through a tubular feature of the sliding assembly in which feature water is present, thus strongly directionally ejecting this water as a slug;

wherein the ejected slug of water provides motive force to the housing.

36. The aquatic propulsion system according to claim 35 for use by a scuba diver wherein the housing is affixed to the scuba tank; and wherein the ejected slug of water provides motive force to the housing, to the scuba tank to which the housing is affixed, and to a scuba diver wearing the scuba tank.

37. The aquatic propulsion system according to claim 35 in use with a floating aquatic platform from the group consisting of surf boards, rescue boards, and floating aquatic maneuvering units.

38. A water slug ejection system usable with a source of compressed air, the water slug ejection system comprising:

a housing defining a chamber accumulating compressed air from the external source of compressed air;

a sliding assembly dividing the chamber into two portions, the sliding assembly having an apertured tubular feature extending through an orifice of the chamber; and a pressure relief valve periodically venting a first portion of the chamber so as to move the sliding assembly within the chamber, the sliding assembly when moved letting all the compressed air stored within the second portion of the chamber egress the chamber through a the orifice of the tubular feature, and through a tube of the tubular feature in which water is present, thus strongly directionally ejecting this water as a slug.

39. The water slug ejection system according to claim 38 in use with a water-expelling device from the group consisting of water-expelling decorative water fountains; and water-expelling water cannons.

* * * * *